US009731468B2

(12) United States Patent
Streich et al.

(10) Patent No.: US 9,731,468 B2
(45) Date of Patent: Aug. 15, 2017

(54) PACKAGE WITH LOCKING WINDOW MEMBER

(71) Applicant: TARGET BRANDS, INC., Minneapolis, MN (US)

(72) Inventors: Jacob Streich, St. Louis Park, MN (US); Dustin Berglin, St. Paul, MN (US); Richard P. Riedel, Blaine, MN (US); Jason Zheng Songying, Shenzhen (CN); Timothy M. Magner, Champlin, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 352 days.

(21) Appl. No.: 14/515,897

(22) Filed: Oct. 16, 2014

(65) Prior Publication Data

US 2016/0107799 A1 Apr. 21, 2016

(51) Int. Cl.

| | |
|---|---|
| ***B65D 25/54*** | (2006.01) |
| ***B31B 1/82*** | (2006.01) |
| ***B65D 5/42*** | (2006.01) |
| ***B65D 5/498*** | (2006.01) |
| ***B65D 5/50*** | (2006.01) |
| *B65D 5/68* | (2006.01) |

(52) U.S. Cl.
CPC ..... *B31B 1/82* (2013.01); *B65D 5/4204* (2013.01); *B65D 5/48048* (2013.01); *B65D 5/5021* (2013.01); *B65D 5/5061* (2013.01)

(58) Field of Classification Search
CPC ..... B65D 5/20; B65D 5/2004; B65D 5/2009; B65D 5/2057; B65D 5/30; B65D 5/4204; B65D 5/48048; B65D 5/5021; B65D 5/5061; B61B 1/82
USPC ..... 220/663, 62; 229/122.22, 125.26, 229/125.32, 162.1
See application file for complete search history.

(56) References Cited

U.S. PATENT DOCUMENTS

| | | | | |
|---|---|---|---|---|
| 2,111,838 A | | 3/1938 | Brown | |
| 2,366,419 A | | 1/1945 | Meller | |
| 2,547,849 A | | 4/1951 | Barry | |
| 2,778,487 A | * | 1/1957 | Raeburn | B65D 5/22 206/459.5 |
| 2,893,622 A | * | 7/1959 | Fogel | B65D 5/2009 229/162.1 |
| 2,944,727 A | | 7/1960 | Moore | |

(Continued)

*Primary Examiner* — J. Gregory Pickett
*Assistant Examiner* — Niki M Eloshway
(74) *Attorney, Agent, or Firm* — JoAnn M. Seaton; Griffiths & Seaton PLLC

(57) ABSTRACT

A package includes a box and a window member. The box includes a primary panel, internal panels collectively defining a chamber therebetween and adjacent the primary panel, and a face panel extending across the chamber spaced from the primary panel. The at least one of the internal panels defines a slot facing the chamber. The face panel includes a tab extending outwardly from a remainder of the face panel, and the tab is received within the slot to at least partially maintain the face panel within the chamber. The window member includes a first wall covering the chamber and a second wall extending from the first wall and positioned within the chamber. The second wall defines a free edge and a cutout extending from the free edge into the second wall. The cutout is slidably receives the tab of the face panel securely coupling the window member to the box.

20 Claims, 25 Drawing Sheets

(56) References Cited

U.S. PATENT DOCUMENTS

| | | | | | |
|---|---|---|---|---|---|
| 3,019,957 | A | | 2/1962 | Palmer | |
| 3,255,870 | A | | 6/1966 | Peck | |
| 3,342,401 | A | | 9/1967 | Kitchell | |
| 3,362,529 | A | | 1/1968 | Gant et al. | |
| 3,451,535 | A | | 6/1969 | Caplan | |
| 3,499,597 | A | * | 3/1970 | Katzman | B65D 5/20 206/525 |
| 3,670,881 | A | | 6/1972 | Dutcher | |
| 3,684,159 | A | | 8/1972 | Wolfe | |
| 3,910,483 | A | * | 10/1975 | Ritter | B65D 5/28 229/117.16 |
| 4,700,883 | A | | 10/1987 | Vajtay et al. | |
| 4,955,469 | A | | 9/1990 | Hudspith | |
| 5,100,052 | A | | 3/1992 | Vajtay | |
| 5,413,217 | A | * | 5/1995 | Sauer | B65D 77/0433 206/363 |
| 6,427,907 | B1 | * | 8/2002 | Espinoza | B65D 5/2038 229/122 |
| 6,948,617 | B2 | | 9/2005 | Kanter et al. | |
| 2006/0231602 | A1 | | 10/2006 | Mu et al. | |
| 2013/0048533 | A1 | * | 2/2013 | McDonald | B65D 5/6661 206/591 |

* cited by examiner

PACKAGE WITH LOCKING WINDOW MEMBER

BACKGROUND OF THE INVENTION

Various types of packaging are used for storing and displaying products, for example, in a retail environment. It is often desirable to allow a potential consumer to see a product housed within the packaging before purchase. To facilitate consumer viewing, in retail environments, clear plastic clamshell containers or blister packages are commonly used. Other packaging techniques incorporate clear viewing windows or other features visually displaying the products through the associated package(s). In some instances, such packages are difficult to open, are not readily reusable, and/or have relatively high assembly costs.

SUMMARY OF THE INVENTION

One aspect of the present invention relates to a package for maintaining and displaying products. The package includes a box and a window member. The box includes a primary panel, a plurality of internal panels collectively defining a chamber therebetween and adjacent the primary panel, and a face panel extending across the chamber and spaced from the primary panel. The at least one of the plurality of internal panels defines an elongated slot facing the chamber. The face panel includes a tab extending outwardly from a perimeter of a remainder of the face panel, and the tab is received within the elongated slot to at least partially maintain the face panel within the chamber. The window member includes a first wall covering the chamber, and a second wall extending from the first wall and positioned within the chamber. The second wall defines a free edge opposite the first wall and a cutout extending from the free edge into the second wall. The cutout is slidably receives the tab of the face panel in a manner securely coupling the window member to the box. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Packages for products being offered for retail sale not only serve as containers for the products during transport and store placement, but also enhance the products by presenting the product in a manner designed to encourage product purchase or to otherwise market the product to promote its purchase. Packages, as described herein, are configured to present one or more products in an open chamber of a box with a window member covering the chamber to enclose the product(s) therein. Such packages allow the user to visually assess the products prior to deciding whether to purchase the product while still protecting the products from inadvertent damage during transport and display. The packages are configured for relatively easy construction, in one embodiment, free from adhesives or other securement devices presenting a clean overall package and product display while lowering overall manufacturing costs associated with the package. In one example, the window member of each package is secured to a corresponding box of the package using interaction between a box tab and a locking reception cutout of the window member resulting from substantially linear movement of the window member into a box opening. Other features and embodiments are also described below.

Figure 1:
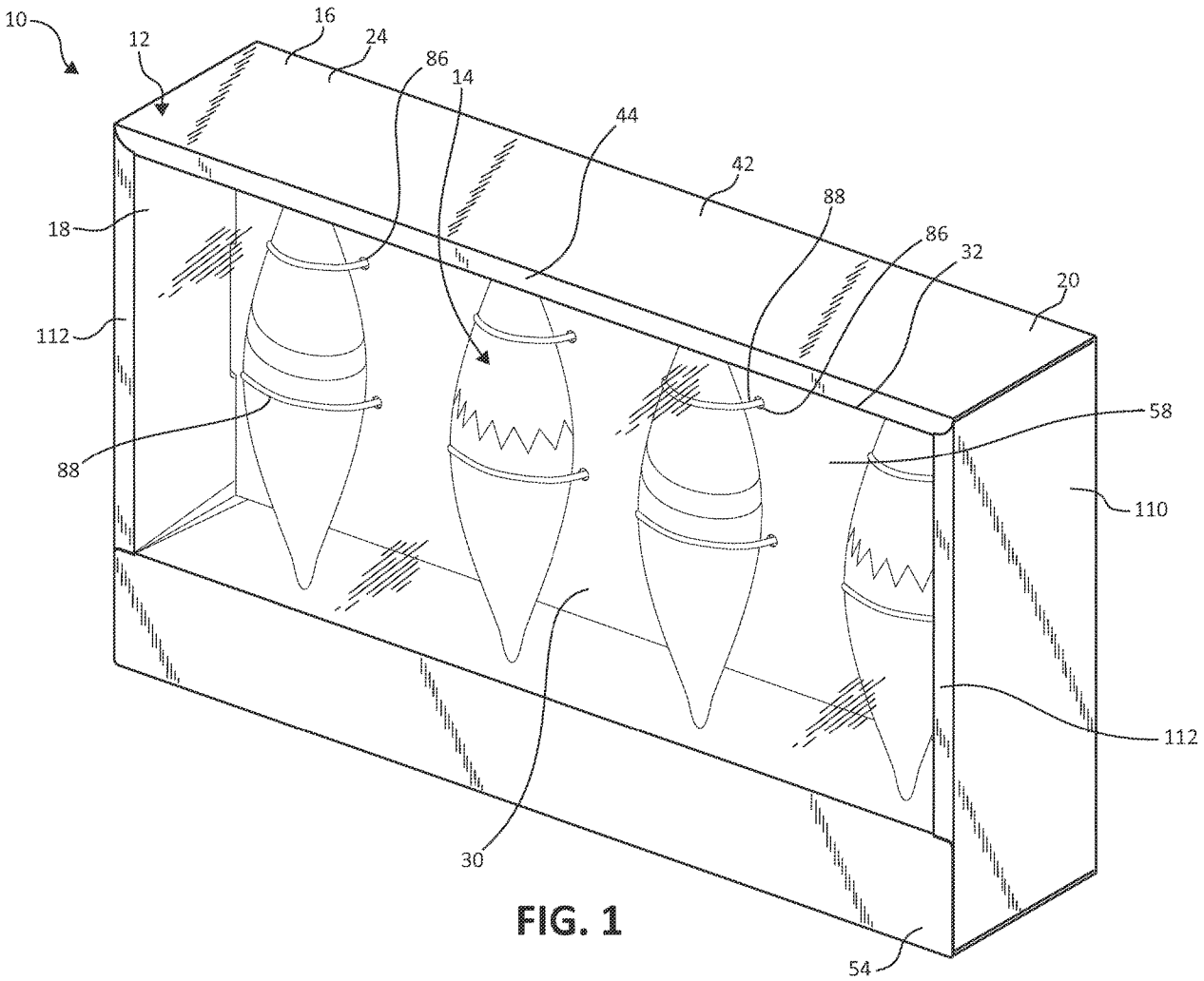
FIG. 1 is a perspective illustration of a packaged product, according to one embodiment of the present invention.
Figure 2:
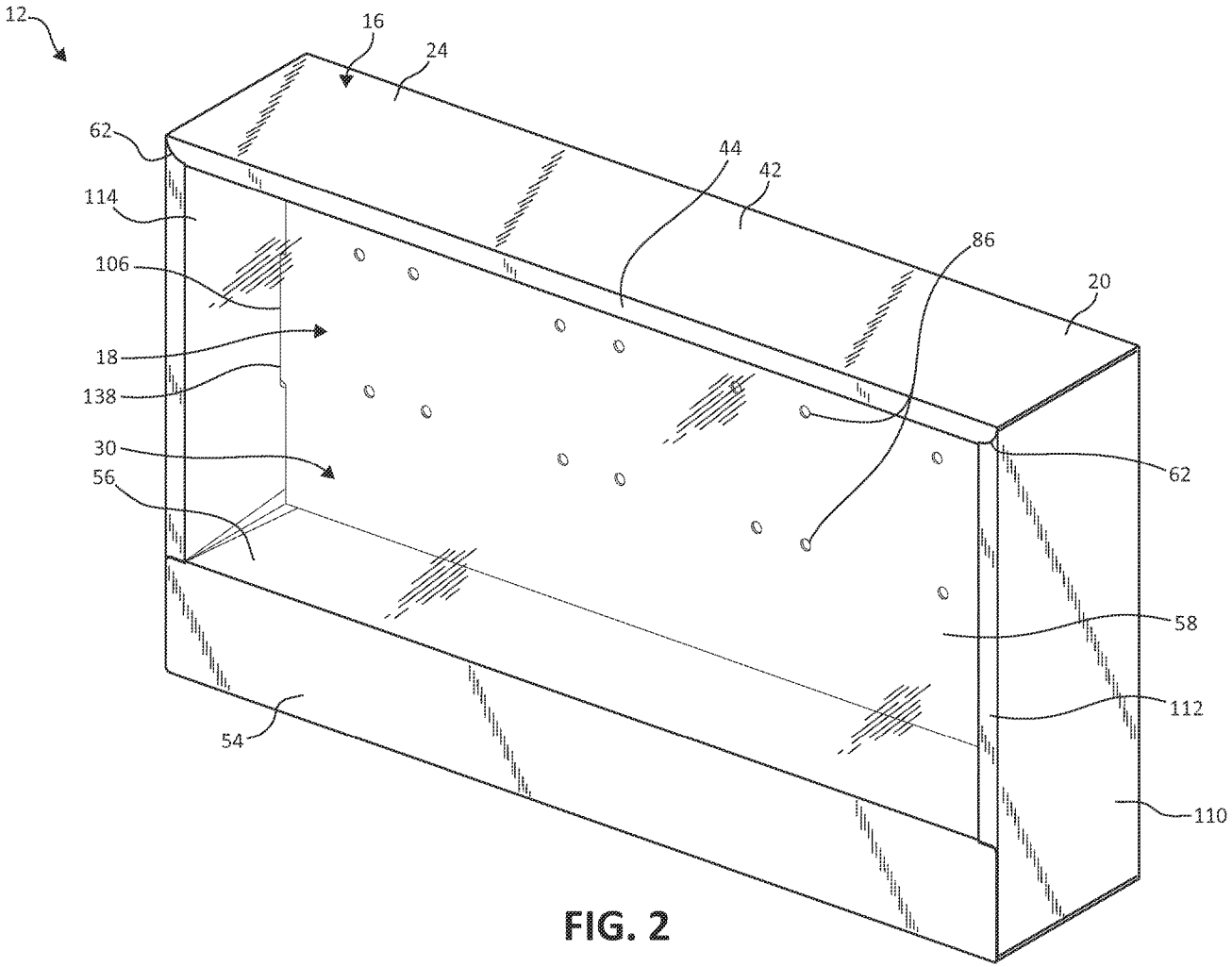
FIG. 2 is a front perspective view illustration of a package of the packaged product of FIG. 1, according to one embodiment of the present invention.
Figure 3:
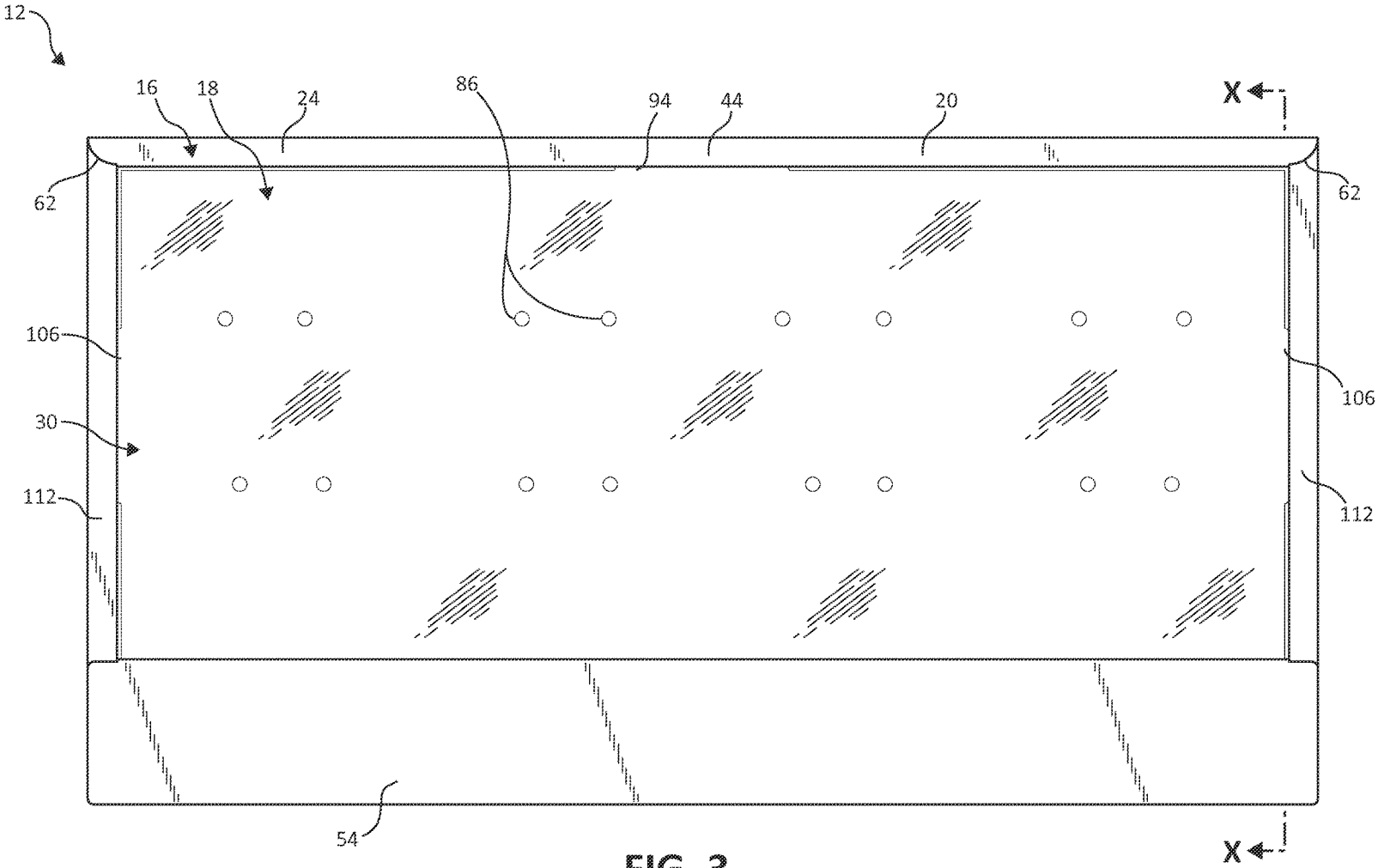
FIG. 3 is a front view illustration of the package of FIG. 2, according to one embodiment of the present invention.
Figure 4:
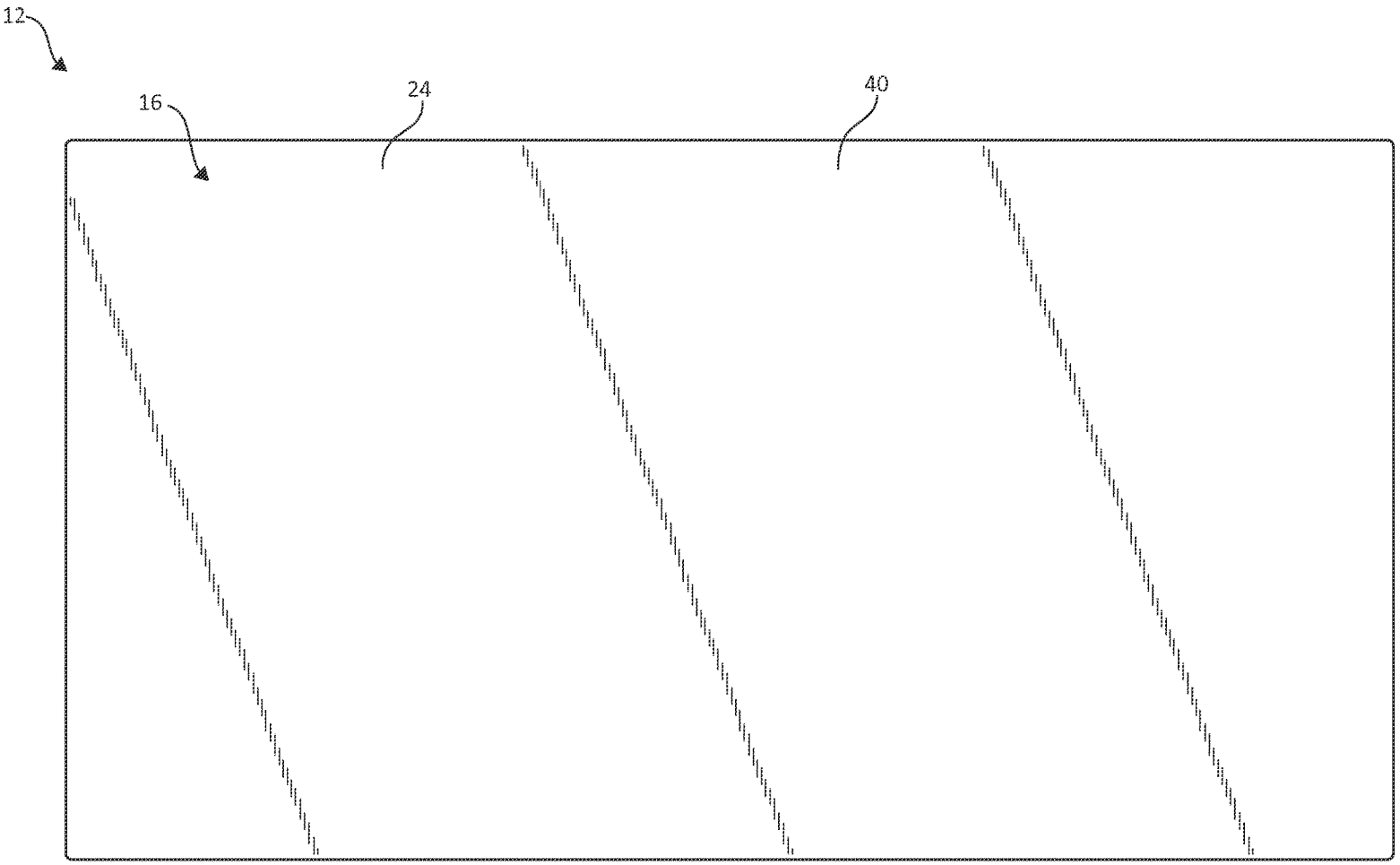
FIG. 4 is a rear view illustration of the package of FIG. 2, according to one embodiment of the present invention.
Figure 5:
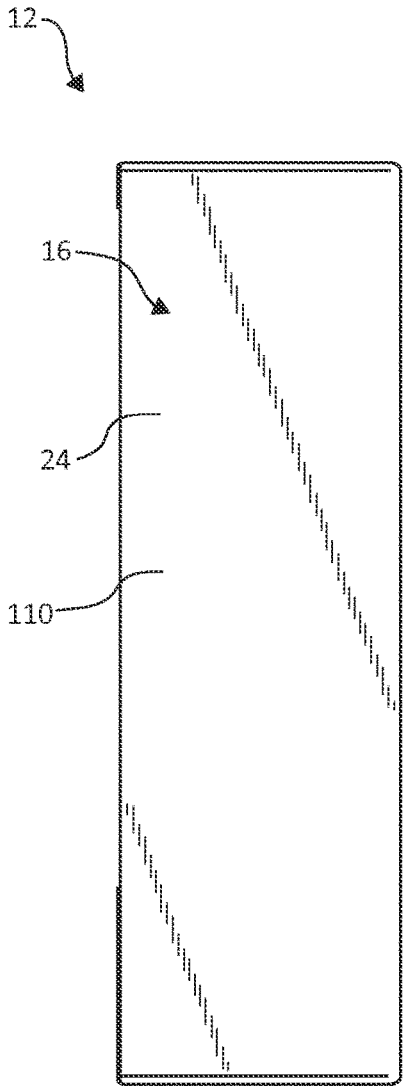
FIG. 5 is a right side view illustration of the package of FIG. 2 where the left side view is a mirror image thereof, according to one embodiment of the present invention.
Figure 6:
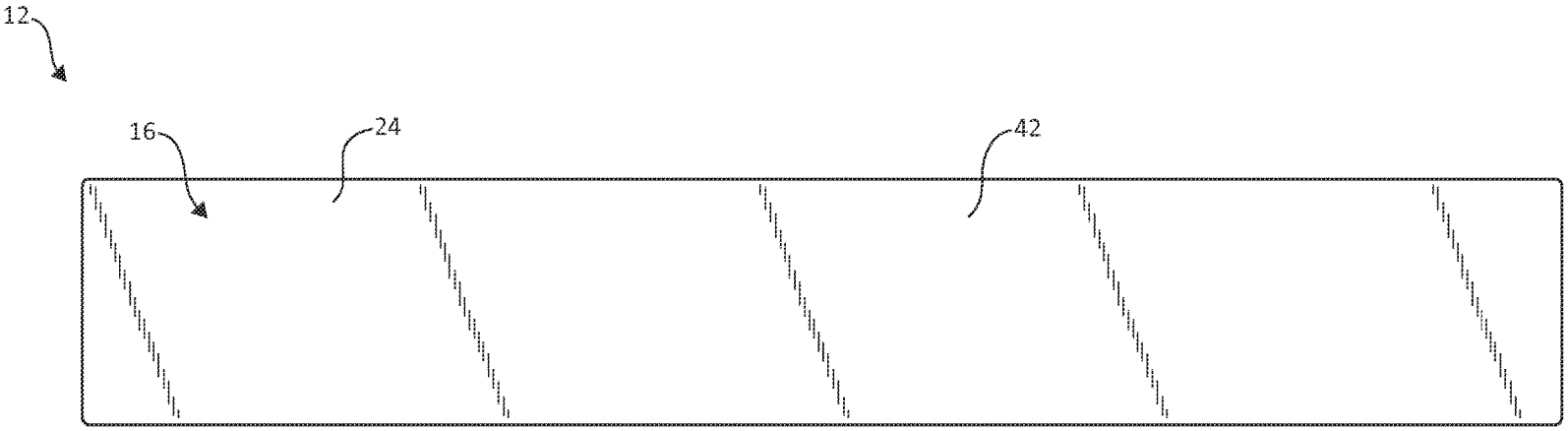
FIG. 6 is a top view illustration of the package of FIG. 2, according to one embodiment of the present invention.
Figure 7:
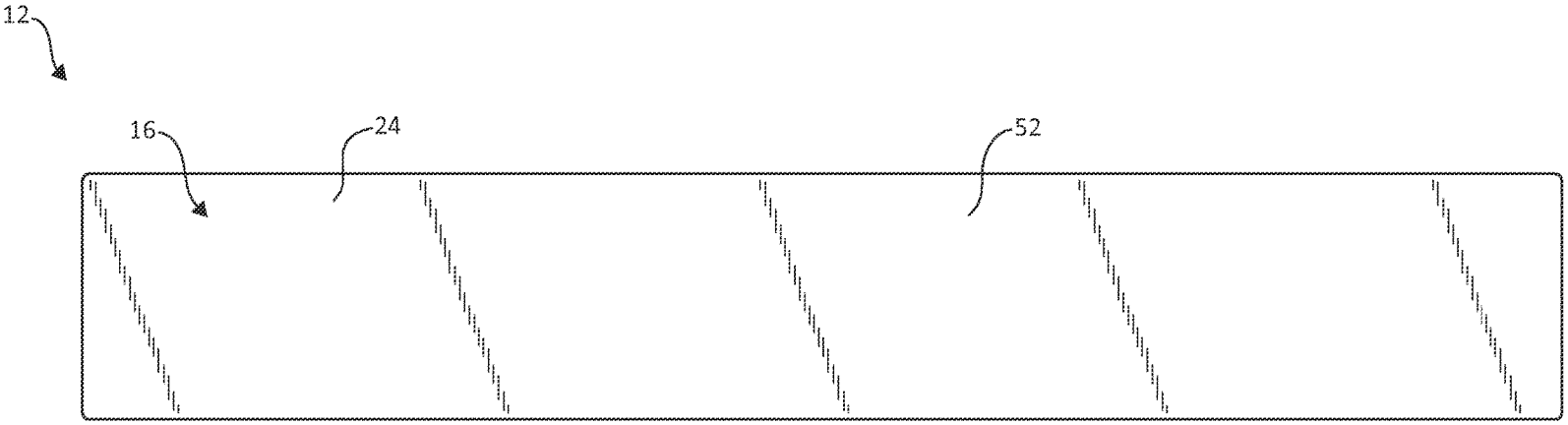
FIG. 7 is a bottom view illustration of the package of FIG. 2, according to one embodiment of the present invention.

Turning to the figures, FIG. 1 illustrates a packaged product 10 including a package 12 and one or more products 14 maintained therein, according to one embodiment of the present invention. Package 12 includes a box 16 and a window member 18 selectively coupled to one another to collectively enclose products 14 therein while allowing potential consumers to view products 14 through window member 18. In one example, package 12 includes a locking mechanism for selectively maintaining window member 18 coupled with box 16 without need for additional tools or coupling devices, as will be further described below.

Figure 8:
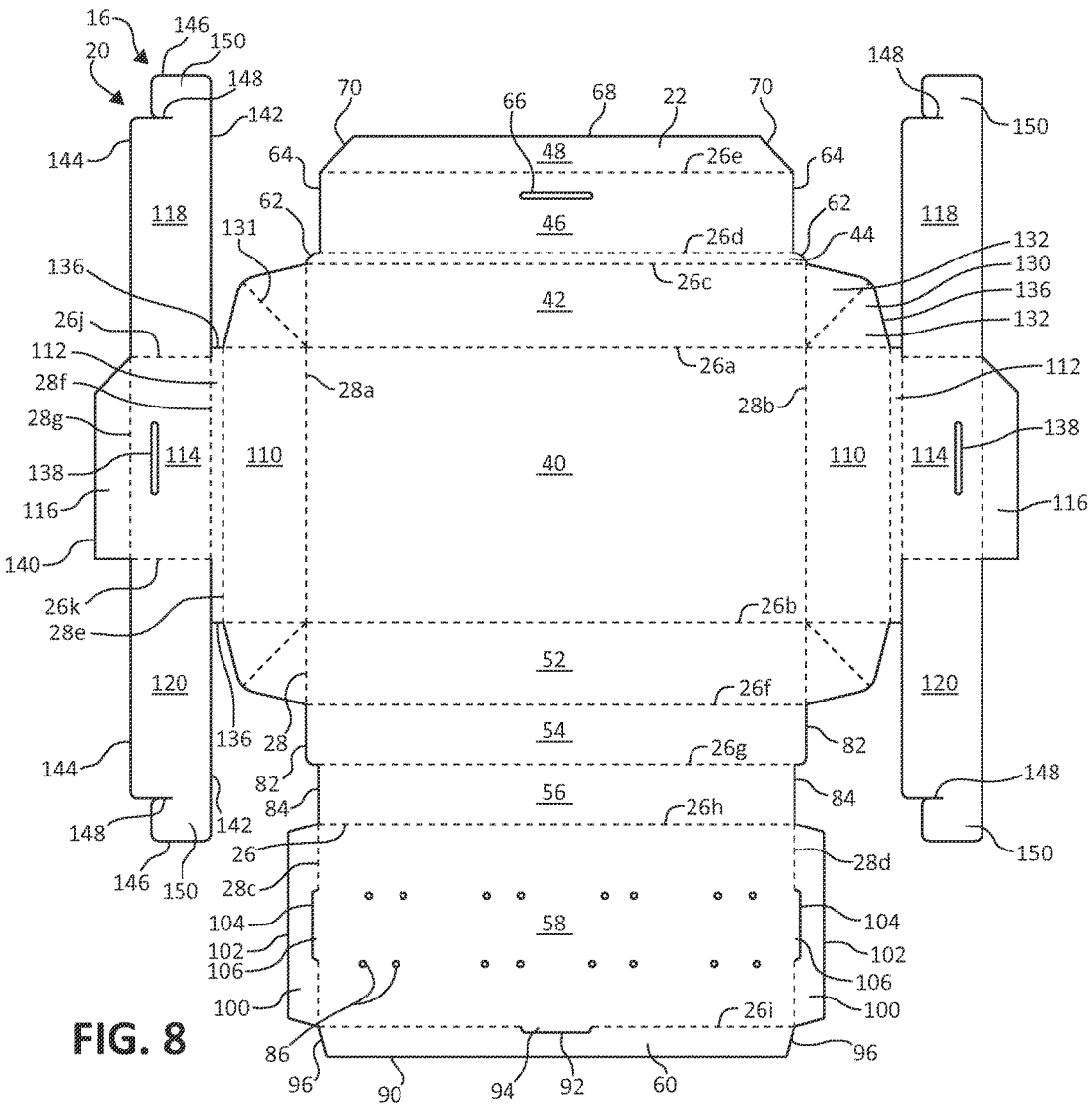
FIG. 8 is front view illustration of a box of the package of FIG. 2 in an unfolded configuration, according to one embodiment of the present invention.

FIGS. 2-7 illustrate one embodiment of package 12. In one example, box 16 of package 12 is formed by folding a single planar member 20, as shown in FIG. 8, of paperboard, cardboard, or similar material having structural stability while also being foldable to extend in different planes. Planar member 20 defines an substantially interior or first surface 22 and a substantially exterior or second surface 24 and is cut to define a plurality of box sections divided by longitudinal fold lines 26 and lateral fold lines 28. In one embodiment, each of longitudinal fold lines 26 is substantially linear and is substantially parallel to one another and substantially perpendicular to each of lateral fold lines 28. Each of the lateral fold lines 28 is substantially linear and extends substantially parallel to each of the other lateral fold lines 28. Box 16 folds to define a storage cavity or chamber 30 for holding product(s) 14 and having an opening 32 open to a front side of box 16. Box 16 slidably receives window member 18 within chamber 30 to cover opening 32, and window member 18 securely couples with box 16 to cover opening 32 until a consumer wishes to open package 12, as will be described in additional detail below.

More specifically and primarily referring to FIG. 8, in one example, box 16, defines a primary panel, for example, a rear panel 40, which is substantially rectangular or otherwise suitably shaped, between a first longitudinal fold line 26*a* and an opposite second longitudinal fold line 26*b* and between a first lateral fold line 28*a* and an opposite second lateral fold line 28*b*. Box 16 additionally defines an external top panel 42, a top front panel 44, an internal top panel 46, and a rear flange 48 all on a first or top side of rear panel 40 and an external bottom panel 52, a bottom front panel 54, an internal bottom panel 56, a face panel 58, and a top coupling flange 60 on a second or bottom side of rear panel 40.

External top panel 42 borders rear panel 40 along first longitudinal fold line 26*a* and extends away from that border to a third longitudinal fold line 26*c*, for example, a distance that is substantially equal to an overall thickness of box 16. Similar to rear panel 40, a width of external top panel 42 is defined between first and second lateral fold lines 28*a* and 28*b* and, in one embodiment, is equal to an overall width of box 16. Top front panel 44 extends from third longitudinal fold line 26*c* to a fourth longitudinal fold line 26*d* with a width defined between opposing free edges 62, which linearly or curvilinearly taper inwardly from corresponding first and second lateral fold lines 28*a* and 28*b*. In one example, the distance between third longitudinal fold line 26*c* and fourth longitudinal fold line 26*d* is substantially equal to or greater than double a thickness of planar member 20 and less than an overall thickness of box 16.

Internal top panel 46 extends from fourth longitudinal fold line 26*d* to a fifth longitudinal fold line 26*e* with a width defined between opposing free edges 64. In one embodiment, internal top panel 46 extends from fourth longitudinal fold line 26*d* to a fifth longitudinal fold line 26*e* a distance slightly less than a distance external top panel 42 extends between first longitudinal fold line 26*a* and third longitudinal fold line 26*c*. Each of opposing free edges 64 extends substantially parallel to lateral fold lines 28 from fourth longitudinal fold line 26*d* to fifth longitudinal fold line 26*e*. In one example, internal top panel 46 defines an elongated slot 66 extending substantially parallel to longitudinal fold lines 28, for instance, substantially centered between free edges 64 and nearer to fifth longitudinal fold line 26*e* than to fourth longitudinal fold line 26*d*.

Rear flange 48 extends from fifth longitudinal fold line 26*e* to a longitudinally extending free edge 68. Opposing side free edges 70 extend from fifth longitudinal fold line 263 and opposing free edges 64 toward free edge with an inward taper, for example, with a taper of about 45 degrees or more.

External bottom panel 52 borders rear panel 40 along second longitudinal fold line 26*b* and extends away from that border to a sixth longitudinal fold line 26*f*, for example, a distance that is substantially equal to an overall thickness of box 16 and/or equal to a distance external top panel 42 extends between first longitudinal fold line 26*a* and third longitudinal fold line 26*c*. Similar to rear panel 40, a width of external bottom panel 52 is defined between first and second lateral fold lines 28*a* and 28*b* and, in one embodiment, is equal to the overall width of box 16. Bottom front panel 54 extends from sixth longitudinal fold line 26*f* to a seventh longitudinal fold line 26*g* with a width defined between opposing free edges 62, where free edges 62 linearly or curvilinearly taper inwardly from corresponding first and second lateral fold lines 28*a* and 28*b*. In one example, the distance between third longitudinal fold line 26*c* and fourth longitudinal fold line 26*d* is substantially equal to or greater than double a thickness of planar member 20 and less than an overall thickness of box 16.

Internal top panel 46 extends from fourth longitudinal fold line 26*d* to a fifth longitudinal fold line 26*e* with a width defined between opposing free edges 64. In one embodiment, internal top panel 46 extends from fourth longitudinal fold line 26*d* to a fifth longitudinal fold line 26*e* a distance slightly less than a distance external top panel 42 extends between first longitudinal fold line 26*a* and third longitudinal fold line 26*c*. Each of opposing free edges 64 extends substantially parallel to lateral fold lines 28 from fourth longitudinal fold line 26*d* to fifth longitudinal fold line 26*e*. In one example, internal top panel 46 defines an elongated slot 66 extending substantially parallel to longitudinal fold lines 28, for instance, substantially centered between free edges 64 and nearer to fifth longitudinal fold line 26*e* than to fourth longitudinal fold line 26*d*.

Rear flange 48 extends from fifth longitudinal fold line 26*e* to a longitudinally extending free edge 68. Opposing side free edges 70 extend from fifth longitudinal fold line 26*e* and opposing free edges 64 toward free edge with an inward taper, for example, with a taper between about 30 degrees and about 60 degrees, for example, with a taper of about 45 degrees or more.

External bottom panel 52 borders rear panel 40 along second longitudinal fold line 26*b* and extends away from that border to a sixth longitudinal fold line 26*f* a distance that, in one example, is substantially equal to an overall thickness of box 16, which, in one embodiment, is also substantially equal to a distance external top panel 43 extends from rear panel 40. Similar to rear panel 40, a width of external bottom panel 52 is defined between first and second lateral fold lines 28*a* and 28*b* and, in one embodiment, is equal to an overall width of box 16. Bottom front panel 54 extends from sixth longitudinal fold line 26*f* to a seventh longitudinal fold line 26*g* with a width defined between opposing free edges 82, when free edges 82 collinearly extend from respective ones of first and second lateral fold lines 28*a* and 28*b*. In one example, the distance between sixth longitudinal fold line 26*f* and seventh longitudinal fold line 26*g* is substantially equal to or greater the thickness of external top panel 42.

Internal bottom panel 56 extends from seventh longitudinal fold line 26*g* to an eighth longitudinal fold line 26*h* with a width defined between opposing free edges 84. Each of opposing free edges 84 extends substantially parallel to lateral fold lines 28 from seventh longitudinal fold line 26*g* to eighth longitudinal fold line 26*h*, for example, each of opposing free edges 84 are inset from a different one of opposing free edges 82 adjacent bottom front panel 54.

Face panel 58 extends from eighth longitudinal fold line 26*h* to a ninth longitudinal fold line 26*i* a distance, which, in one example, is sized to substantially fill a height of chamber 30 or at least of opening 32 to chamber 30. In one example, face panel 58 longitudinally extends between lateral third and fourth fold lines 28*c* and 28*d* to define a width substantially equal to or slightly less than an overall width of chamber 30 or at least of opening 32 of chamber 30. In one embodiment, third and forth lateral fold lines 28*c* and 28*d* are each inset from a respective on of first and second lateral fold lines 28*a* and 28*b*.

In the embodiment of FIGS. 1-15, a portion of second surface 24 defined by face panel 58 will serve as a backdrop for any product 14 housed by box 16. According to an example, face panel 58 defines apertures 86 extending therethrough and/or other features to facilitated coupling the one or more products 14 face panel 58 and, therefore, all of box 16. For instance, as illustrated in at least FIGS. 1-3 and 8-12, face panel 58 defines a number of apertures 86 for receiving a twist tie, plastic cable tie, or other coupling member 88 (FIG. 1) or portion of product(s) 14 to secure product(s) 14 to face panel 58. Other features of face panel 58, such as protrusions, loops, indentations, etc. are also contemplated to facilitate coupling products 14 with box 16.

Top coupling flange 60 extends from ninth longitudinal fold line 26*i* to a longitudinally extending free edge 90. In one example, top coupling flange 60 tapers inwardly at opposing sides edges 96 thereof as top coupling flange 60 extends from ninth longitudinal fold line 26*i* to opposing free longitudinal edge 90, for example, with a taper of about 45 degrees or more. In one embodiment, box 16 includes a substantially U-shaped cutout 92 substantially centered on ninth fold line 26*i* and extending from ninth fold line 26*i* into top coupling flange 60. When box 16 is folded along ninth fold line 26*i*, a tab 94 is formed within the confines of cutout 92.

One of opposing side coupling flanges 100 is formed on either side of face panel 58. More particularly, each of opposing side coupling flanges 100 extends from a corresponding one of third and fourth lateral fold lines 28*c* and 28*d* outwardly from face panel 58 to an opposite free edge 102. In one example, each side coupling flange 100 tapers inwardly as the corresponding side coupling flange 100 extends toward free edge 102 thereof, for instance, with an angle of at least 45 degrees. In one embodiment, box 16 includes substantially U-shaped cutouts 104 that are each substantially centered on a different one of third and fourth lateral fold lines 28*c* and 28*d* and that each extend from one of third and fourth lateral fold lines 28*c* and 28*d* into a corresponding one of side coupling flanges 100. When box 16 is folded along third and fourth lateral fold lines 28*c* and 28*d*, tabs 106 are each formed within the confines of each of the respective ones of cutouts 104.

Box 16 additionally includes portions foldable to form sidewalls thereof. For example, box 16 includes an external side panel 110, a side front panel 112, an internal side panel 114, a rear side coupling flange 116, a first support segment 118, and a second support segment 120 on each side of rear panel 40. While one side of box 16 including one of each of external side panel 110, side front panel 112, internal side panel 114, rear side coupling flange 116, first support segment 118, and second support segment 120 is primarily described here, a second substantially identical side is formed on an opposite side of rear panel 40 as a substantially symmetrical manner other than end portions of first and second support segment 118 and 120, as will be further described below, according to one embodiment.

External side panel 110, more particularly, extends from first lateral fold line 28*a* adjacent rear panel 40 in a direction extending away from rear panel 40 to a sixth lateral fold line 28*f*. A height of external side panel 110 is substantially equal to rear panel 40, and, in one example, is defined between first and second longitudinal fold lines 26*a* and 26*b*. In one example, external side panel 110 extends from first lateral fold line 28*a* a distance substantially equal to a distance external top panel 42 extends between first longitudinal fold line 26*a* and third longitudinal fold line 26*c* and/or a distance external bottom panel 52 extends between second longitudinal fold line 26*b* and sixth longitudinal fold line 26*f*.

In one embodiment, corner panels 130 are formed between each one of external top panel 42 and external bottom panel 52 and each one of external side panels 110. Each corner panel 130 is generally rectangular and extends between either of first longitudinal fold line 28*a* and second longitudinal fold line 28*b* and either of first lateral fold line 28*a* and second lateral fold line 28*b* diagonally opposite rear panel 40. In one example, a fold line 131 extends from an intersection between one of first and second longitudinal fold lines 28*a* and 28*b* and one of first or second lateral fold lines 28*a* and 28*b* in an angle non-parallel and non-perpendicular to either of longitudinal fold lines 26 and lateral fold lines 28 to an opposite location of corner panel 130. Fold line 131 divides corner panel 130 into two parts including a first corner half 132 and a second corner half 134. Each corner panel 130 provides additional structural rigidity and improves aesthetic appeal of corners of box 16 upon assembly as will be further described below.

In one embodiment, side front panel 112 extends from fifth lateral fold line 28*e* away from external side panel 110 to sixth lateral fold line 28*f*, for example, a distance substantially equal to a distance between third and fourth longitudinal fold lines 26*c* and 26*d*. Side front panel 112 has a height substantially identical to a height of external side panel 110 as defined between opposing longitudinal edges 136, which are each substantially collinear with a different one of first and second longitudinal fold lines 26*a* and 26*b*.

Internal side panel 114 extends away from sixth lateral fold line 28*f* adjacent side front panel 112 to a seventh lateral fold line 28*g*, for example, a distance substantially identical to internal top panel 46. Internal side panel 114 has a height defined between tenth and eleventh longitudinal fold lines

26*j* and 26*k*, which are each inset from longitudinal edges 136. Internal side panel 114 defines an elongated aperture 138 therethrough near tenth longitudinal fold line 26*j*. In one example, internal side panel 114 has a thickness substantially equal to or slightly greater than a thickness of planar member 20 and is sized with a length to receive tab 106 formed adjacent face panel 58 as will be further described below.

Rear side coupling flange 116 extends away from seventh lateral fold line 28*g* adjacent internal side panel 114 to an opposite free edge 140, which extends substantially parallel to seventh lateral fold line 28*g*. Rear side coupling flange 116 has a height substantially identical to a height of internal side panel 114 as measured between tenth and eleventh longitudinal fold lines 26*j* and 26*k*.

Each of first support segment 118 and second support segment 120 extends from opposite ends of internal side panel 114, for example, from a different one of tenth and eleventh longitudinal fold lines 26*j* and 26*k* away from internal side panel 114 to a opposing end 146, for example, in a substantially symmetrical manner.

First and second support segments 118 and 120 extend laterally from opposing sides, for example, from opposite ones of tenth and eleventh longitudinal fold lines 26*j* and 26*k*, away from internal side panel 114 to corresponding opposite longitudinally extending end 146. In one example, each of first and second support segments 118 and 120 extends between two laterally extending side edges 142 and 144, which each extend substantially collinear to a different one of sixth lateral fold line 28*f* and seventh lateral fold line 28*g*, such that internal side panel 114 and first and second support segments 118 and 120 all have a substantially identical height. Near free end 146, each of first and second support segments 118 and 120 defines a slit 148 extending from laterally extending side edge 144 toward, but not to, laterally extending side edges 142 to define a tab 150 adjacent free end 146 at least on one side of box 16. In one embodiment, each slit 148 extends substantially half way across a height of the corresponding one of first and second support segments 118 and 120. While side portions of box 16 are largely symmetrical, notably slits 148 and tabs 150 are not symmetrical but rather all are formed on similar sides, e.g., left or right, of corresponding ones of first and second support segments 118 and 120.

Figure 9:
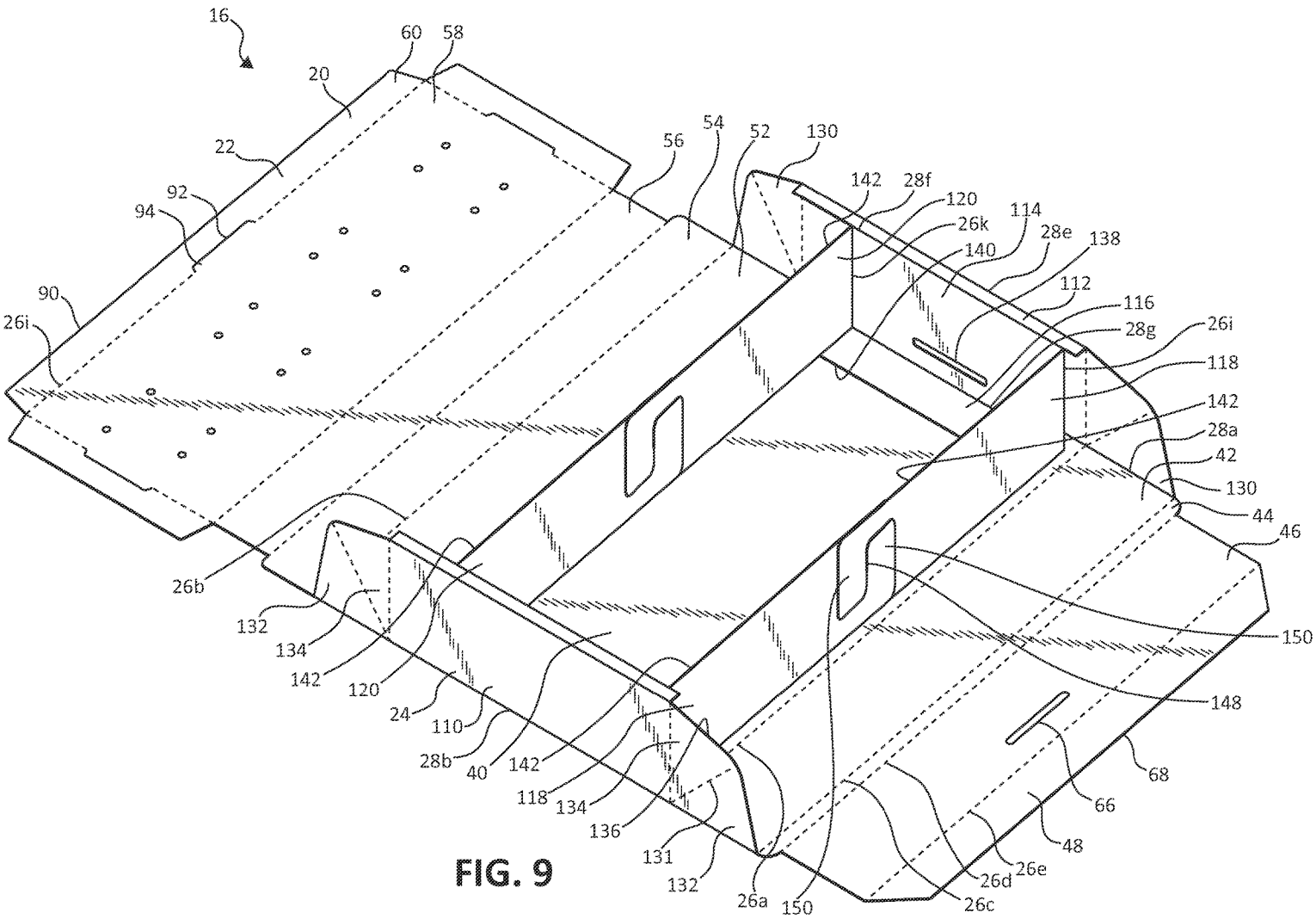
FIG. 9 is a perspective view illustration of the box of FIG. 8 in a partially assembled configuration, according to one embodiment of the present invention.

Referring to FIG. 8 and FIG. 9, during assembly according to one embodiment, box 16 is positioned with exterior surface 24 facing down and interior surface 22 facing up. Side structures of box 16 including external side panel 110, side front panel 112, internal side panel 114, rear side coupling flange 116, and first and second support segments 118 and 120 are folded upwardly about corresponding ones of first and second lateral fold lines 28*a* and 28*b*. Each side structure is further folded inwardly about a corresponding fifth lateral fold line 28*e* until side front panel 112 extends substantially parallel to rear panel 40. Internal side panel 114, rear side coupling flange 116 and first and second support segments 118 and 120 are folded downwardly relative to side front panel 112 until internal side panel 114 extends substantially parallel to exterior side panel 110. When so folded, rear side coupling flange 116 also folds upwardly about seventh lateral fold line 28*g* to extend substantially parallel with and abut rear panel 40. In one example, rear side coupling flange 116 is secured to rear panel 40 with adhesives, while in other example no such fastening agent is employed to secure rear side coupling flange 116 in the position illustrated in FIG. 9.

Next, first and second support segments 118 and 120 are each folded inwardly toward the other side structure about corresponding ones of tenth and eleventh longitudinal fold lines 26*j* and 26*k*, in one embodiment. The two first support segments 118 are selectively coupled to one another by sliding one of the first support segments 118 through a slit 148 defined in the other one of first support segments 118 and vice versa as shown in FIG. 9. Similarly, the two second support segments 120 are selectively coupled to one another by sliding one of the second support segments 120 through a slit 148 defined in the other one of second support segments 120 and vice versa as shown in FIG. 9. In this manner, the two first support segments 118 and the two second support segments 120 respectively define framework or ribbing for supporting a remainder of box in the assembled position.

Figure 10:
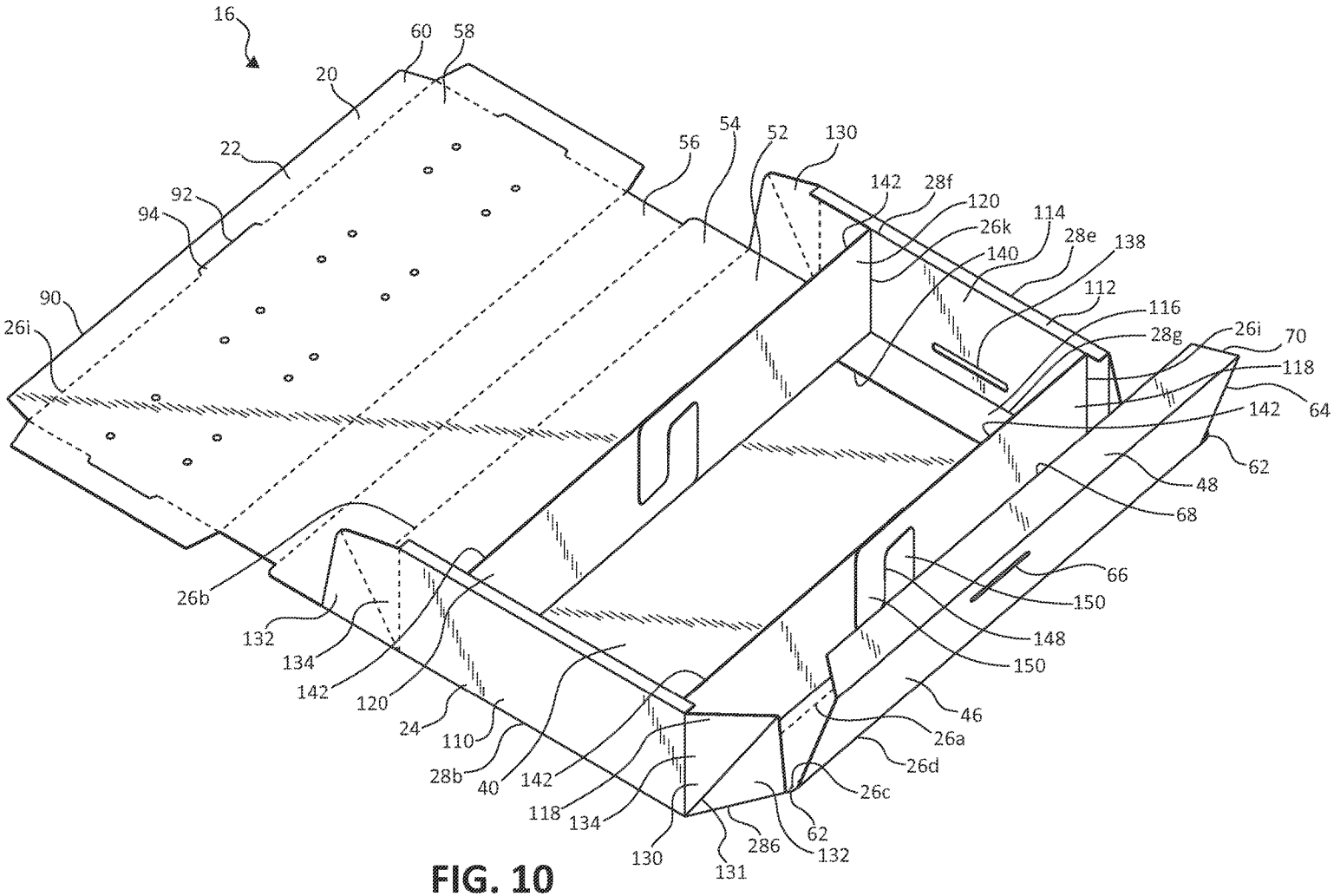
FIG. 10 is a perspective view illustration of the box of FIG. 8 in a partially assembled configuration, according to one embodiment of the present invention.

Additionally referring to FIG. 10, in one embodiment, exterior top panel 42 is folded upwardly relative to rear panel 40 about longitudinal fold line 26*a* and into a position extending substantially perpendicularly relative to rear panel 40 and substantially parallel to each of both first support segments 118. When so folding exterior top panel 42, corner panels 130 are folded inwardly to accommodate folding of exterior top panel 42. More specifically, the two corner panels 130 adjacent exterior top panel 42 each fold inwardly about each of first or second longitudinal fold line 28*a* or 28*b*, depending on the side being folded, and first lateral fold line 26*a* while substantially simultaneously also folding about fold line 131 such that first corner half 132 folds over second corner half 134 forming a sharp and neat corner to box 16 as illustrated with additional reference to FIG. 11.

Figure 11:
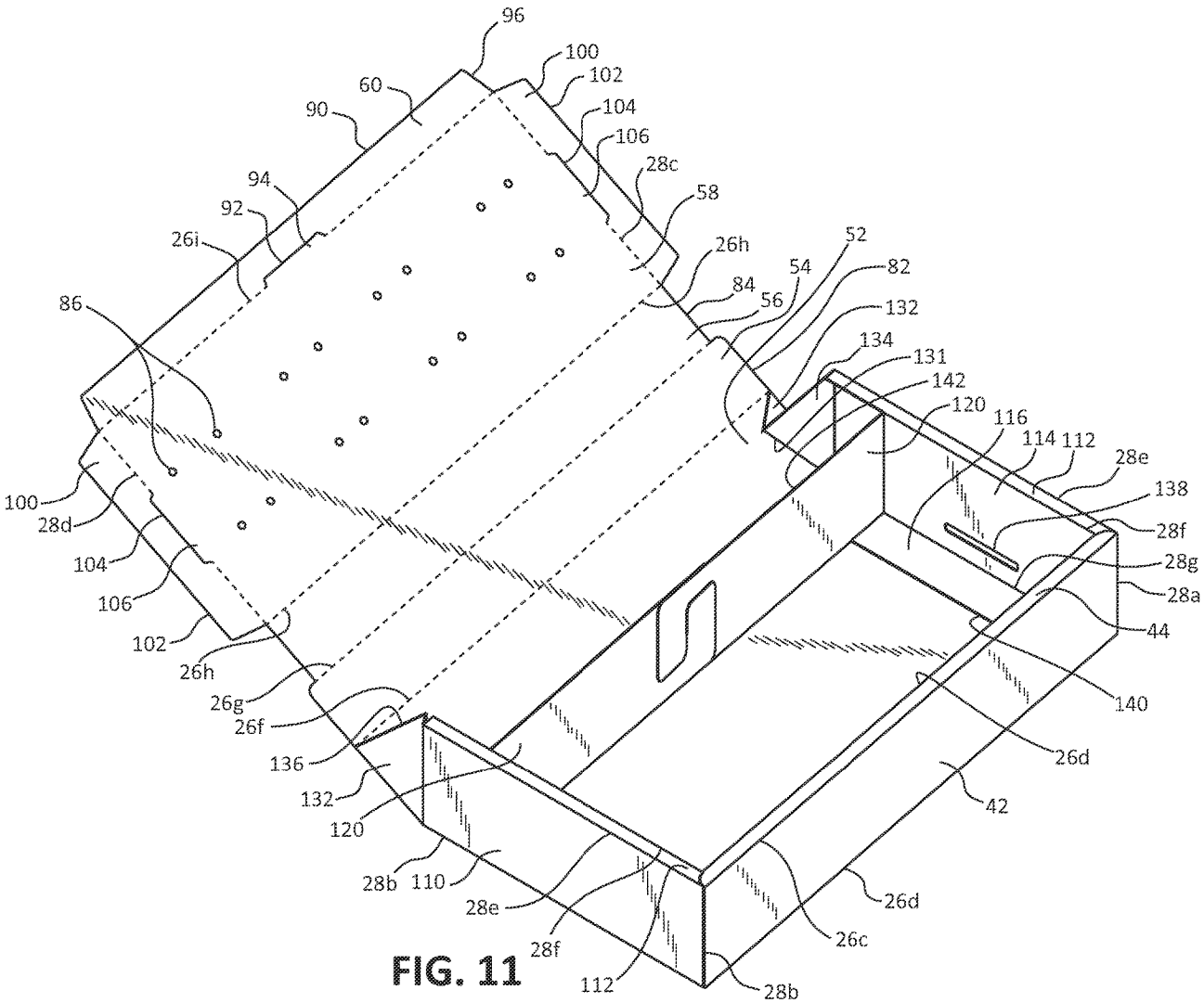
FIG. 11 is a perspective view illustration of the box of FIG. 8 in a partially assembled configuration, according to one embodiment of the present invention.

Continuing to refer to FIG. 11, top front panel 44 folds relative to external top panel 42 about fourth longitudinal fold line 26*d* to extend substantially parallel to rear panel 40 and to extend over edges 142 of first support segments 118. Interior top panel 46 is, in turn, folded about third longitudinal fold line 26*c* to extend substantially perpendicularly to top front panel 44 and rear panel 40 and substantially parallel to external top panel 42 on a side of first support segments 118 opposite external top panel 42. When so folded, a portion of exterior surface 24 defined by interior top panel 46 faces inwardly, and first support segments 118 serve to strengthen a top wall collectively defined by external top panel 42, top front panel 44, and interior top panel 46. In one embodiment, when box 16 is so folded, rear flange 48 folds upwardly to abut and extend substantially parallel with interior surface 22 of rear panel 40. In one embodiment, rear flange 48 is adhered to rear panel 40, while in other embodiments no fastening agent is added to box 16 to secure rear flange 48 to rear panel 40. When so folded, each of elongated apertures 66 and 138 are defined by one of internal top or side panels 46 and 114, which define chamber 30 (along with internal bottom panel 56, as will be described below), and therefore, face chamber 30.

Figure 12:
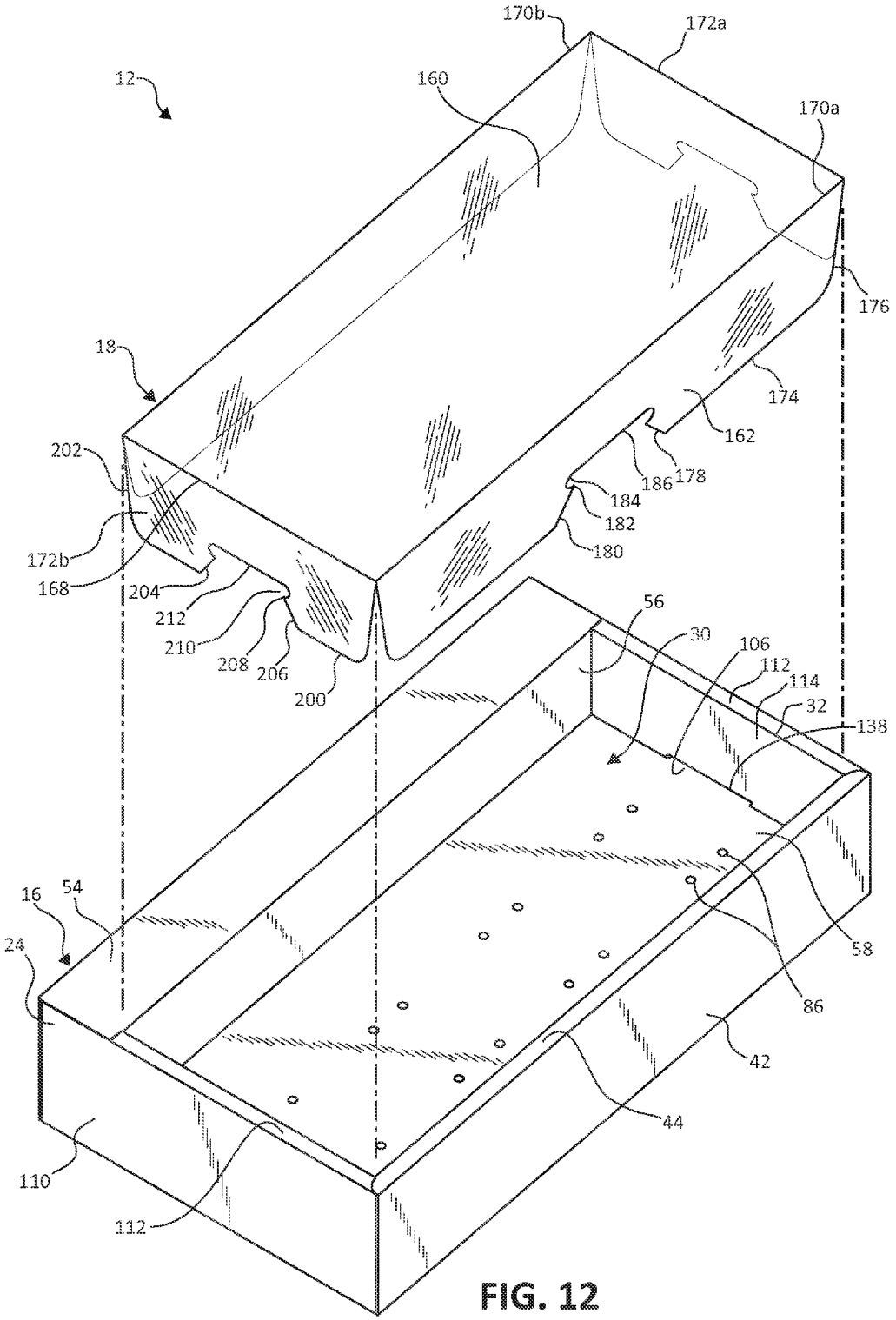
FIG. 12 is an exploded, perspective view illustration of the package of FIG. 2, according to one embodiment of the present invention.

Additionally referring to FIGS. 11 and 12, in one embodiment, exterior bottom panel 52 is folded upwardly relative to rear panel 40 about second longitudinal fold line 26*b* and into a position extending substantially perpendicularly relative to rear panel 40 and substantially parallel to each of both second support segments 120. When so folding exterior bottom panel 52, adjacent corner panels 130 are folded inwardly to accommodate folding of exterior bottom panel 52. More specifically, the two corner panels 130 adjacent exterior bottom panel 52 each fold inwardly about each of first or second longitudinal fold line 28*a* or 28*b*, depending on the side being folded, and second lateral fold line 26*b* while substantially simultaneously folding about associated fold line 131 such that first corner half 132 folds over second corner half 134 forming a sharp and neat corner to box 16.

Continuing to refer to FIGS. 11 and 12, bottom front panel 54 folds relative to external bottom panel 52 about sixth longitudinal fold line 26*f* to extend substantially parallel to rear panel 40 and to extend over edges 142 of second support segments 120. Internal bottom panel 56 is, in turn, folded about seventh longitudinal fold line 26*g* to extend substantially perpendicularly to bottom front panel 54 and rear panel 40 and substantially parallel to external bottom panel 52 on a side of second support segments 120 opposite external bottom panel 52. When so folded, a portion of exterior surface 24 defined by internal bottom panel 56 faces inwardly, and second support segments 120 serve to strengthen a bottom wall collectively defined by external bottom panel 52, bottom front panel 54, and internal bottom panel 56.

In one embodiment, prior to folding internal bottom panel 56 in place, each of opposing side coupling flanges 100 are folded toward interior surface 22 of face panel 58 about third and fourth lateral fold line 28*c* and 28*d*, respectively, to extend substantially perpendicular to face panel 58. When side coupling flanges 100 are so folded, due to cutouts 104, tabs 106 do not fold, but instead remain substantially coplanar with a remainder of face panel 58 and extending outwardly beyond third or fourth lateral fold lines 28*c* and 28*d*. In example, top coupling flange 60 is also folded toward interior surface 22 of face panel 58 about ninth longitudinal fold line 26*i* to extend substantially perpendicular to face panel 58. When top coupling flange 60 is so folded, due to cutouts 92, tabs 94 do not fold, but instead remain substantially coplanar with a remainder of face panel 58 extending outwardly beyond ninth longitudinal fold line 26*i*.

Face panel 58 is folded inwardly and rearwardly about eighth longitudinal fold line 26*h* toward rear panel 40 until free edges 90 and 102 contact rear flanges 48 (FIGS. 8-10) and 116, respectively. As such, face panel 58 is maintained substantially parallel to and spaced from rear panel 40. More specifically, face panel 58 remains spaced from rear panel 40 on one side by internal bottom panel 56 having a smaller depth dimension measured front to back as compared to exterior bottom panel 52 and on the other three sides via rear flanges 48 and 116. Space between face panel 58 and rear panel 40 provides room for storing auxiliary items, instructions, cords, etc. associated with products 14 (FIG. 1) and/or rear portions the connection members 88 holding products 14 to a portion of exterior surface 24 defined by face panel 58 in chamber 30. In one example, products 14 are coupled to exterior surface 24 of face panel 58 via connecting members 88 in the form of twist ties, bands, zip ties, or other similar structure(s) extending through two or more of apertures 86 and around one or more products 14.

Figure 13:
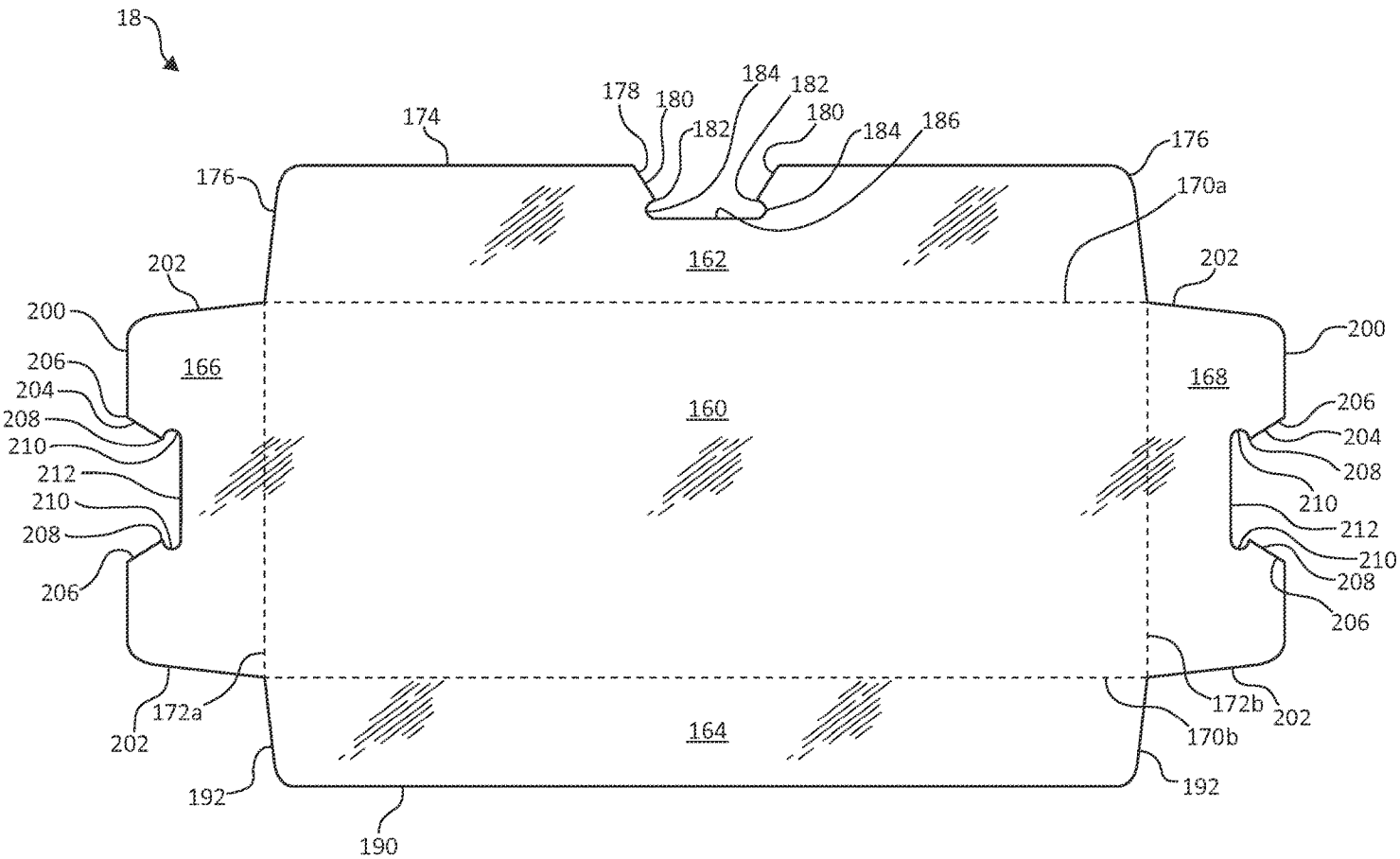
FIG. 13 is a front view illustration of a window member of the package FIG. 2 in an unfolded configuration, according to one embodiment of the present invention.
Figure 14:
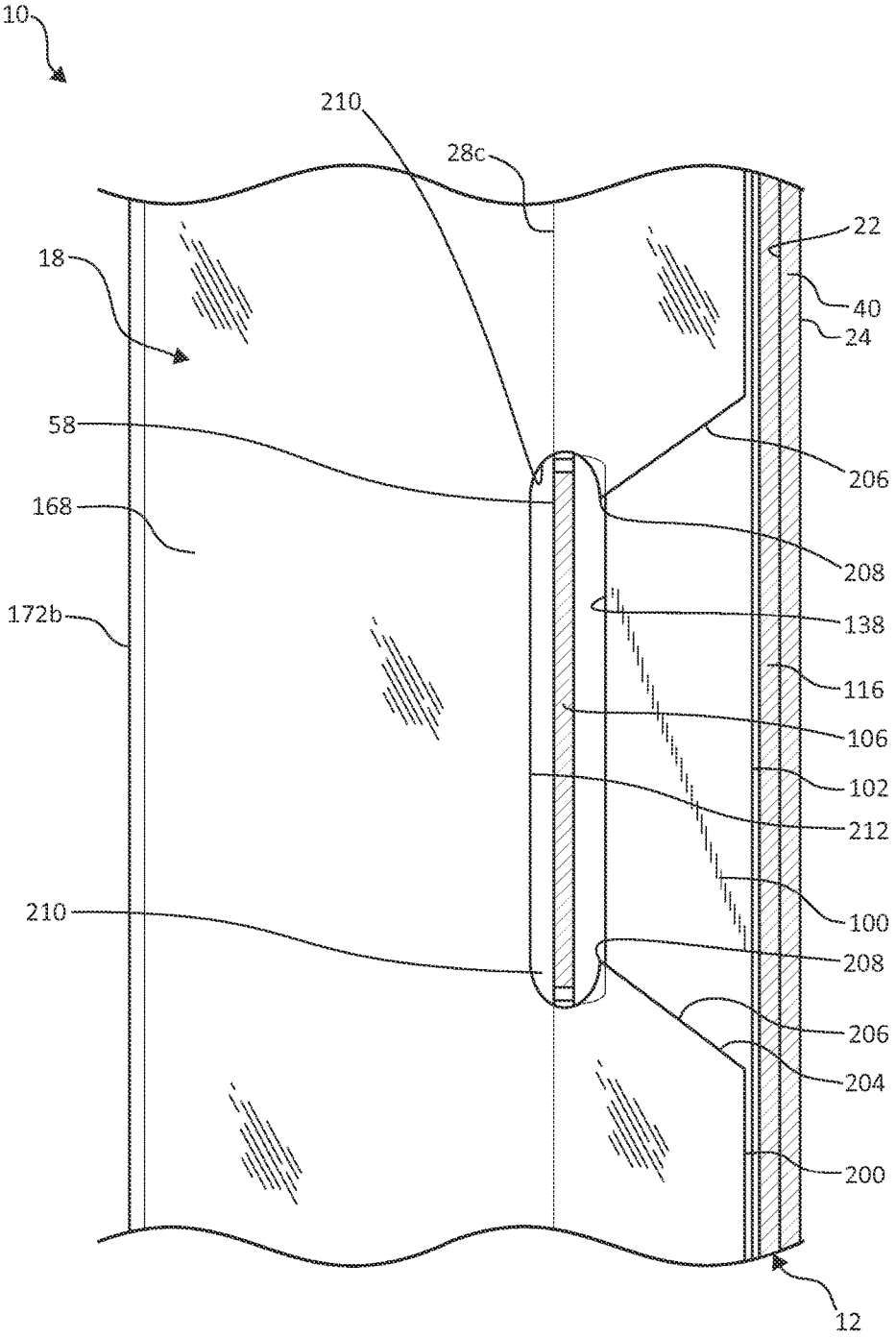
FIG. 14 is a cross sectional illustration taken about the line X-X in FIG. 3, according to one embodiment of the present invention.
Figure 15:
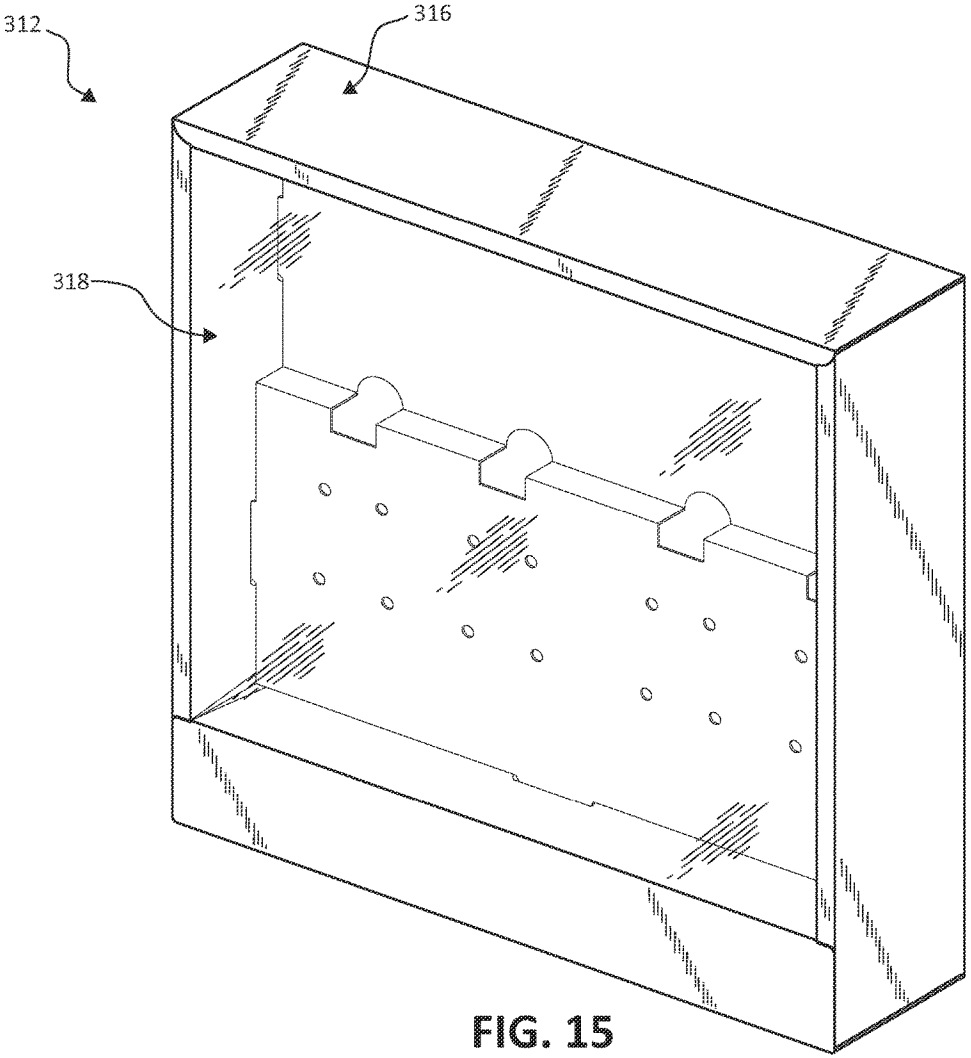
FIG. 15 is a front perspective view illustration of a package, according to one embodiment of the present invention.
Figure 16:
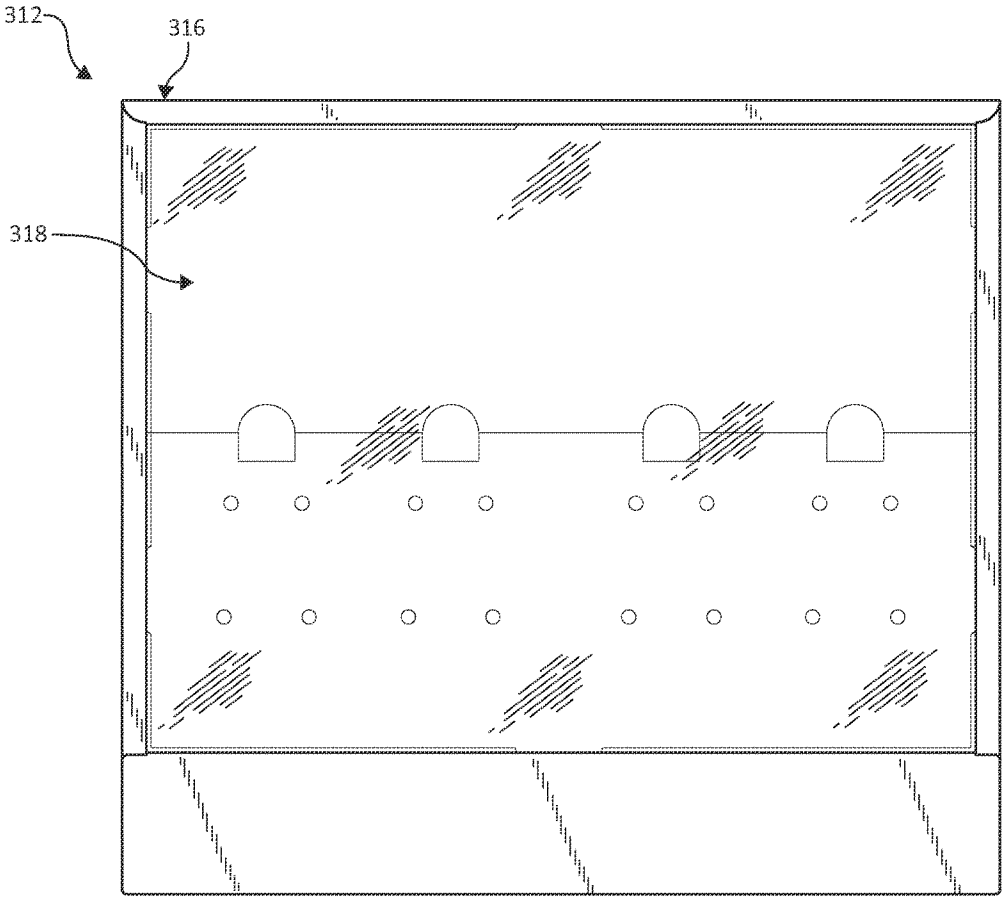
FIG. 16 is a front view illustration of the package of FIG. 15, according to one embodiment of the present invention.
Figure 17:
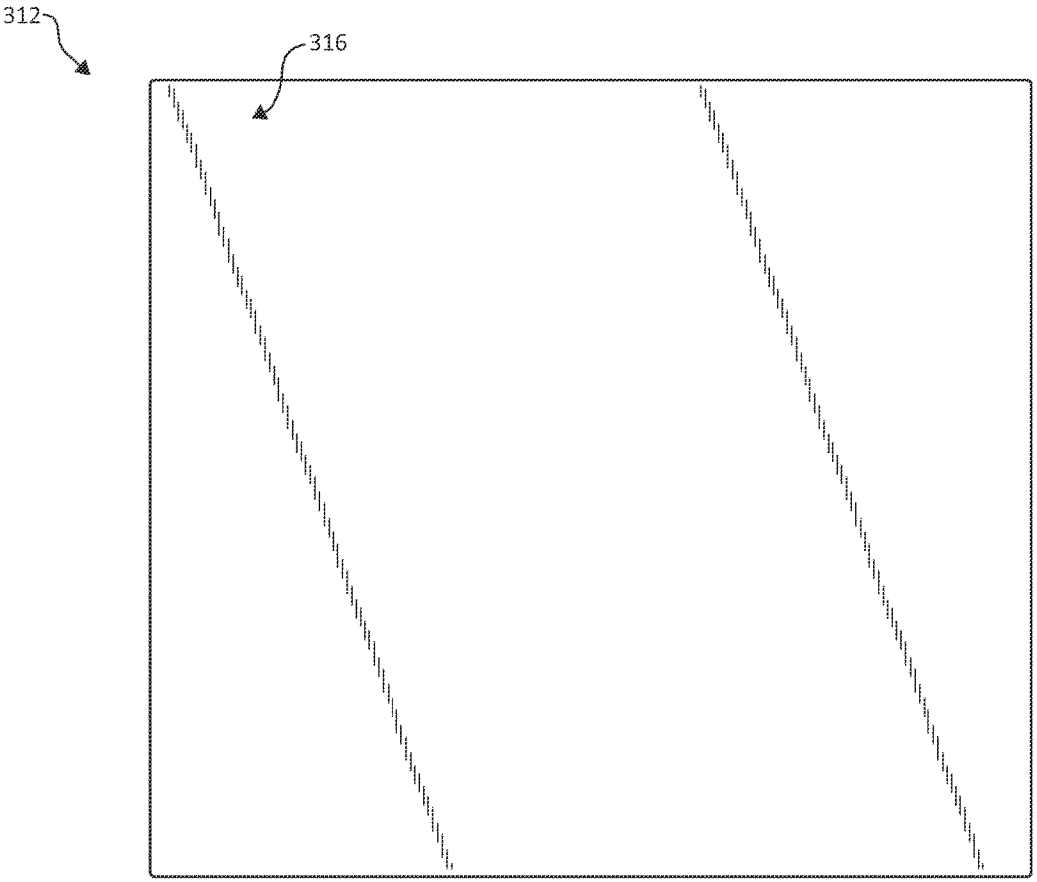
FIG. 17 is a rear view illustration of the package of FIG. 15, according to one embodiment of the present invention.
Figure 18:
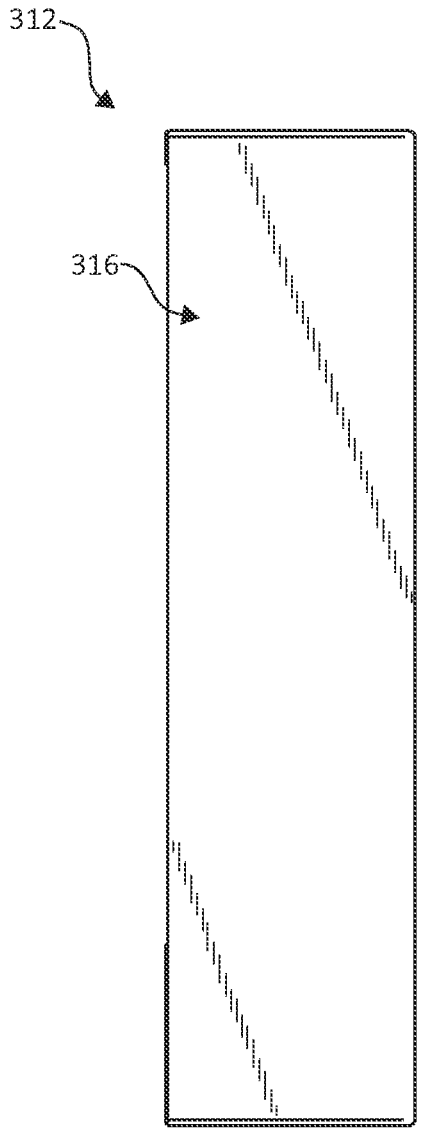
FIG. 18 is a right side view illustration of the package of FIG. 15 where the left side view is a mirror image thereof, according to one embodiment of the present invention.
Figure 19:
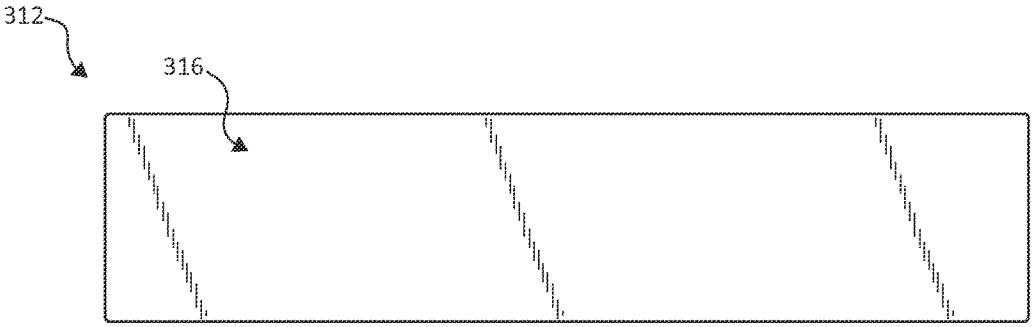
FIG. 19 is a top view illustration of the package of FIG. 15, according to one embodiment of the present invention.
Figure 20:
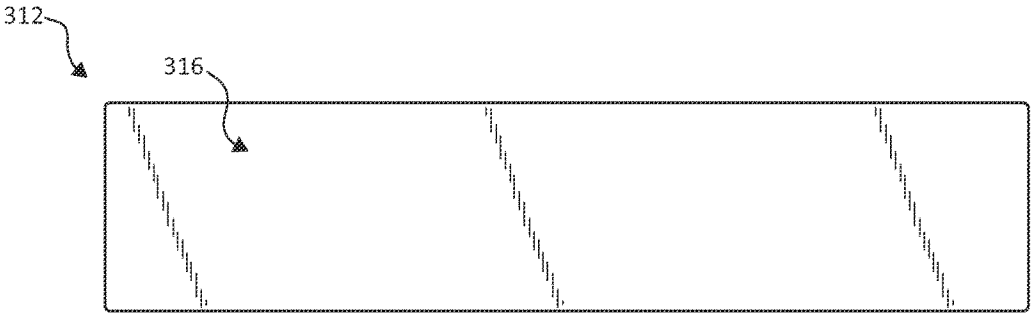
FIG. 20 is a bottom view illustration of the package of FIG. 15, according to one embodiment of the present invention.
Figure 21:
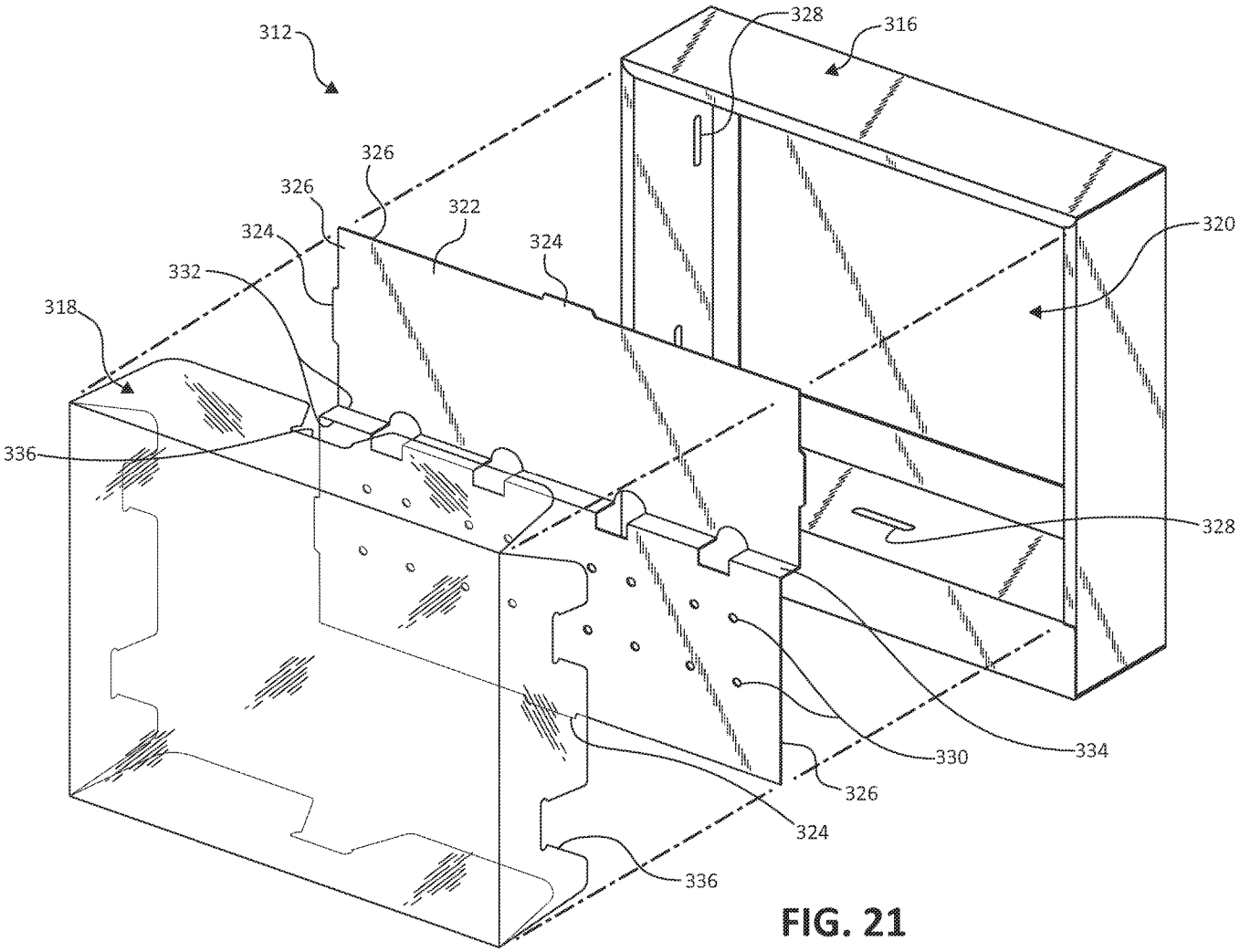
FIG. 21 is an exploded, perspective view illustration of the package of FIG. 15, according to one embodiment of the present invention.
Figure 22:
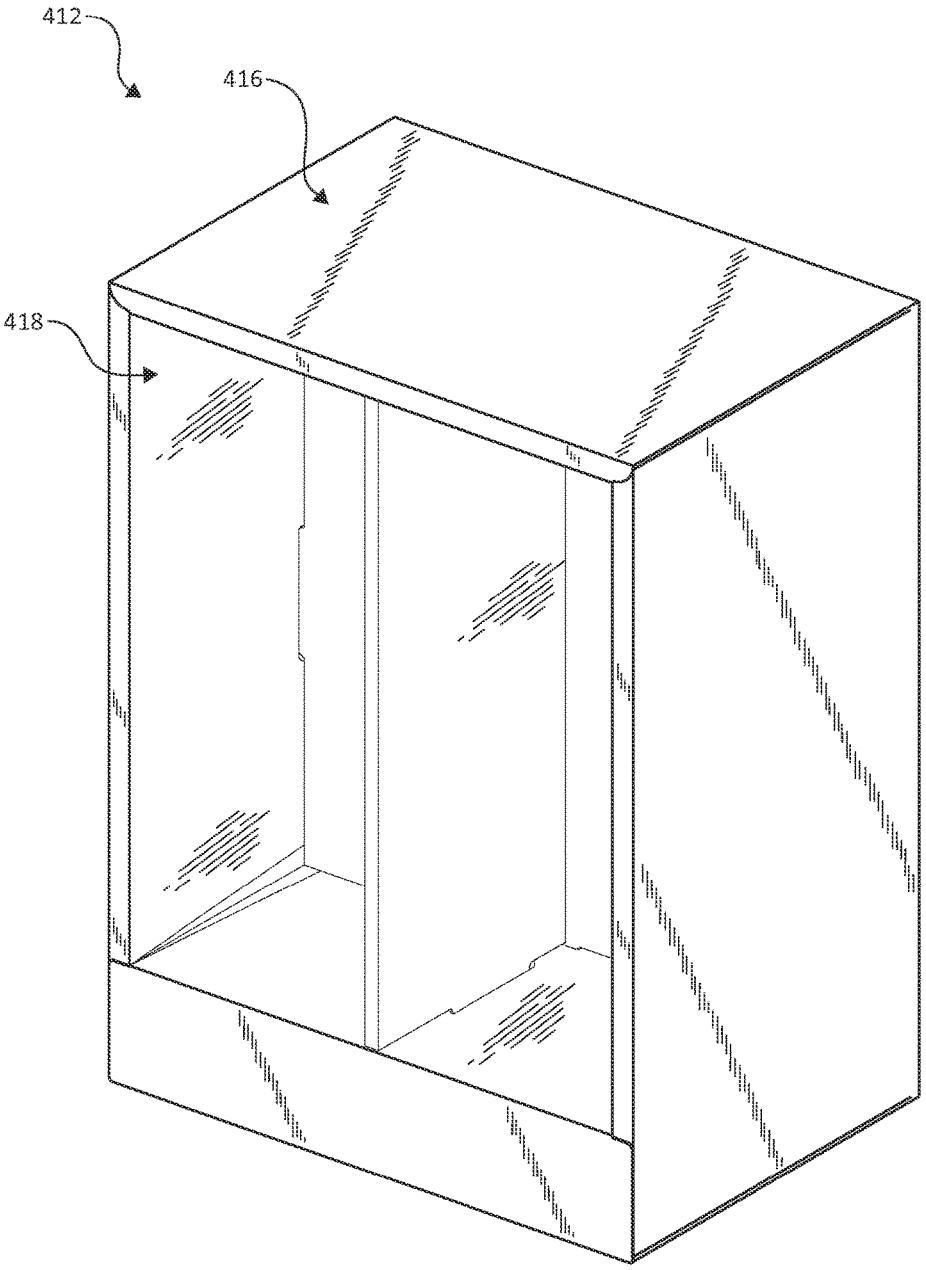
FIG. 22 is a front perspective view illustration of a package, according to one embodiment of the present invention.
Figure 23:
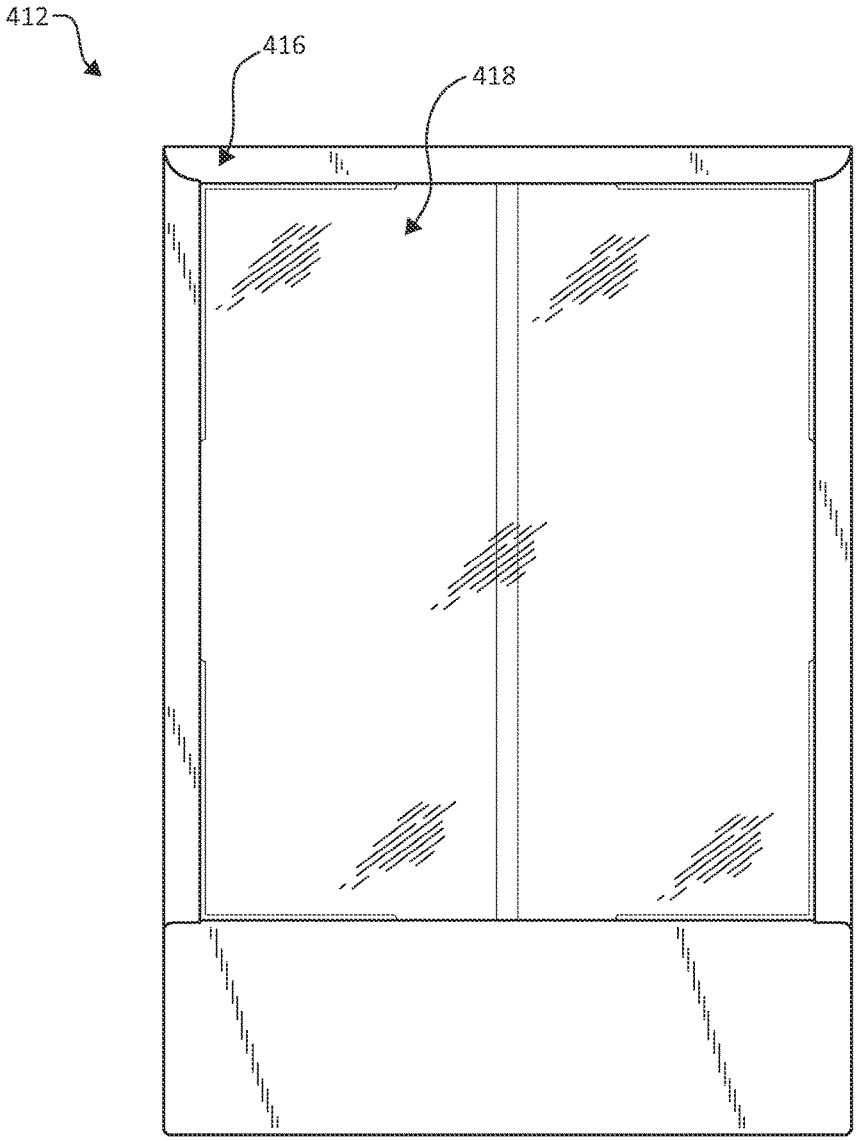
FIG. 23 is a front view illustration of the package of FIG. 22, according to one embodiment of the present invention.
Figure 24:
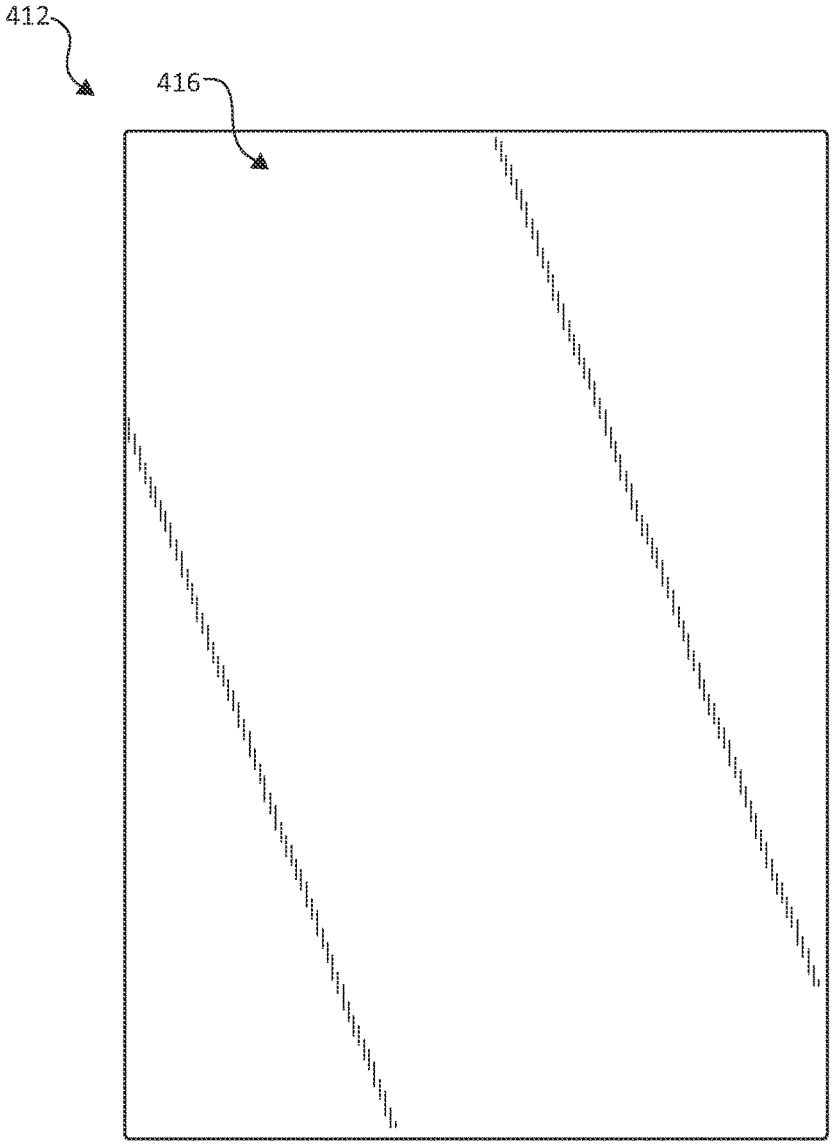
FIG. 24 is a rear view illustration of the package of FIG. 22, according to one embodiment of the present invention.
Figure 25:
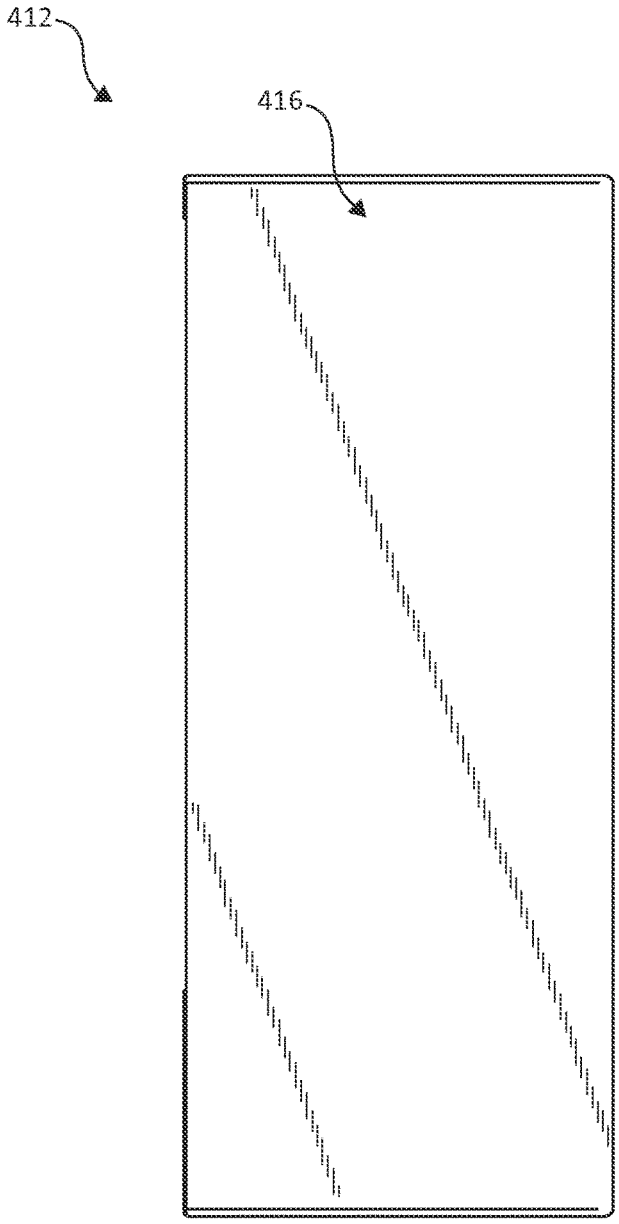
FIG. 25 is a right side view illustration of the package of FIG. 22 where the left side view is a mirror image thereof, according to one embodiment of the present invention.
Figure 26:
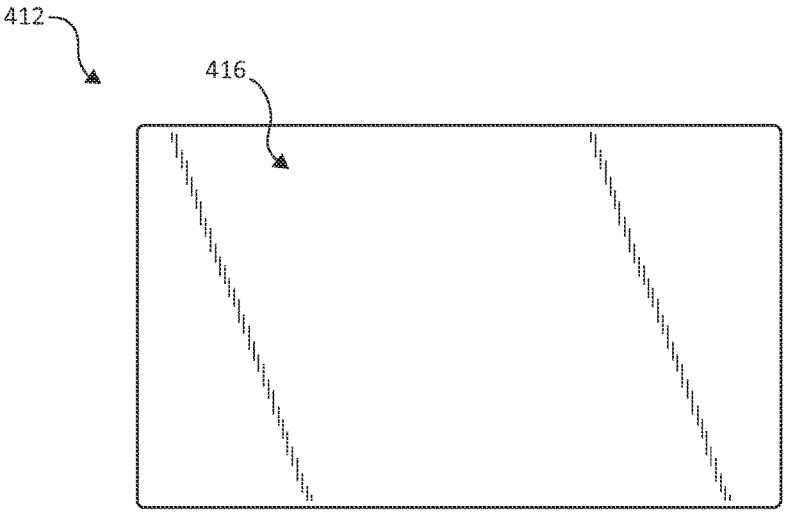
FIG. 26 is a top view illustration of the package of FIG. 22, according to one embodiment of the present invention.
Figure 27:
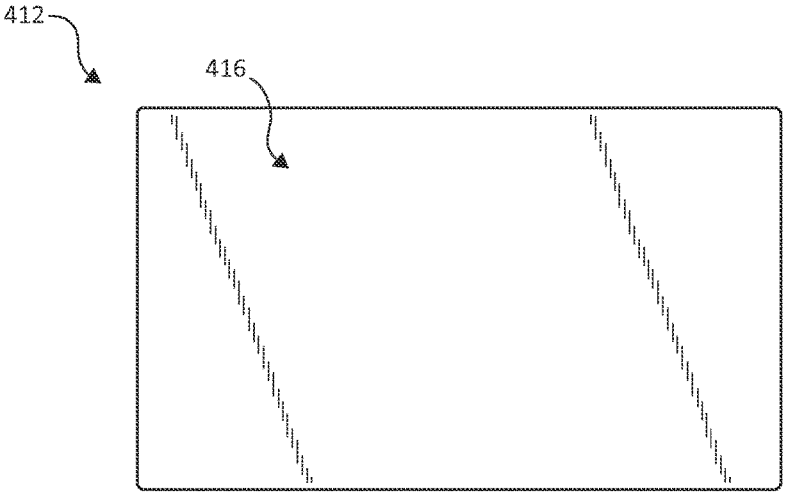
FIG. 27 is a bottom view illustration of the package of FIG. 22, according to one embodiment of the present invention.

Referring to FIG. 12, window member 18 is substantially transparent, that is transparent or at least translucent to cover chamber 30 while still allowing consumers to view products 14 stored therein. In one example, window member 18 is formed of a planar member folded to form three-dimensional window member, and planar member is formed of a suitable material such as polyethylene terephthalate (PET). FIG. 13 illustrates one embodiment of window member 18 in a flat, non-folded configuration. Window member 18 includes a primary or front wall 160, a top wall 162, a bottom wall 164, and sidewalls 166 and 168 divided by longitudinal fold lines 170*a* and 170*b* and lateral fold lines 172*a* and 172*b*. More specifically, front wall 160 is shaped substantially identically to and sized just slightly smaller than opening 32 to chamber 30. In one example, front wall 160 is substantially rectangular and has a height defined between longitudinal fold lines 170*a* and 170*b* and a width defined between lateral fold lines 172*a* and 172*b*. Top wall 162, bottom wall 164, and sidewalls respectively border front wall 160 along one of fold lines 170*a*, 170*b*, 172*a*, and 172*b*, respectively, and extend away from a remainder of front wall 160.

Top wall 162, more specifically, extends from first longitudinal fold line 170*a* to an opposite free edge 174, which is substantially linear and substantially parallel to first longitudinal fold line 170*a* other than an opening or cutout 178, and between opposing free side edges 176 to have a width not greater than the width of front wall 160, in one example. In one example, free side edges 176 each taper inwardly as they extend toward free edge 174, for example, with a taper between about 30 degrees and about 60 degrees, for example, with a taper of about 45 degrees or more. Cutout 178 is configured to receive and lock around tab 94 of box 16 when window member 18 is coupled thereto. In one embodiment, cutout 178 is substantially centered along free edge 174 and includes tapered edges 180 and an elongated portion 184. Tapered edges 180 are positioned on opposite sides of cutout 178 and extend from free edge 174 toward, but not to, longitudinal fold line 170*a* tapering inwardly toward each other as then extend away from free edge 174. Each tapered edge 180 terminates opposite free edge 174 when it intersects elongated portion 184 of cutout 178. In this manner, the two tapered edges 180 collectively define a tapered portion of cutout 178. In one embodiment, each elongated portion 184 is elongated and extends substantially parallel to and spaced from each of longitudinal fold line 170*a* and free edge 174. Elongated portion 184 has a width substantially equal, e.g., just slightly larger than, a width of tab 94.

In one embodiment, tapered edges 178 each intersect elongated portion 184 at a point 182 inwardly inset from an outside edge of elongated portion 184. The two resulting points 182 of cutout 178 are positioned a distance apart that is less than a width of tab 94. As such, when tab 94 is positioned within elongated portion 184 of cutout 178, points 182 contact an rear side of tab 94, thereby, maintaining or locking tab 94 within elongated portion 184 of cutout 178. In one embodiment, elongated portion 184 defines a front edge 186 opposite free edge 174 that is substantially linear and continuous along a width of elongated portion 184. In one example, a distance between first longitudinal fold line 170*a* and front edge 186 of cutout 178 is substantially equal to a distance between top front panel 44 and face panel 158 such that, upon assembly of package 12, front panel 160 extends substantially coplanarly with each of top front panel 44 and bottom front panel 54.

Bottom wall 164 extends from second longitudinal fold line 170*b* to an opposite free edge 190, which is substantially linear and substantially parallel to second longitudinal fold line 170*b*. In one embodiment, bottom wall 164 continuously extends between second longitudinal fold line 170*b* and free edge 190 and between opposing side edge 192 to have a width not greater than the width of front wall 160 and a depth substantially equal to a depth of chamber 30 between face panel 58 and top front panel 44. In one example, free side edges 192 each taper inwardly as they extend toward free edge 190, for example, with a taper between about 30 degrees and about 60 degrees, for example, with a taper of about 45 degrees or more. In one embodiment, bottom wall 164 includes a cutout (not shown) similar to cutout 178 of top wall 162.

Sidewalls 166 and 168 each extend from a different one of first and second lateral fold lines 172*a* and 172*b* to an opposite free edge 200, which is substantially linear and substantially parallel to first and second lateral fold lines 172*a* and 172*b* other than an opening or cutout 204, and between opposing free side edges 202 to have a height not greater than the height of front wall 160, in one example. In one example, free side edges 202 each taper inwardly as they extend toward free edge 200, for example, with a taper between about 30 degrees and about 60 degrees, for example, with a taper of about 45 degrees or more. Cutout 204 is formed substantially identically to cutout 178 and is configured to receive and lock around tabs 106 of box 16 when window member 18 is coupled thereto. In one embodiment, each cutout 204 is substantially centered along a corresponding free edge 200 and includes tapered edges 206 and an elongated portion 210. Tapered edges 206 are positioned on opposite sides of cutout 204 and extend from a corresponding free edge 200 toward, but not to, a corresponding lateral fold line 172*a* or 172*b*, tapering inwardly toward each other as they extend away from free edge 200. Each tapered edge 206 terminates opposite free edge 200 when it intersects elongated portion 210 of cutout 204. In one embodiment, each elongated portion 210 is elongated and extends substantially parallel to and spaced from each of first and second lateral fold lines 172*a* and 172*b* and free edges 200. Elongated portion 210 has a width substantially equal, e.g., just slightly larger than, a width of tab 106 (FIG. 12).

In one embodiment, tapered edges 206 each intersect elongated portion 210 at a point 208 inwardly inset from an outside edge of elongated portion 210. The two resulting points 208 of cutout 204 are positioned a distance apart that is less than a width of tab 106 such that when one of tab 106 is positioned within a corresponding elongated portion 184 of cutout 204, points 208 contact a rear side of tab 106, thereby, maintaining or locking tab 106 within elongated portion 210 of cutout 204. In one embodiment, elongated portion 210 defines a front edge 212 opposite a corresponding free edge 200 that is substantially linear and continuous along a width of elongated portion 210. In one example, a distance between a corresponding first or second lateral fold line 172*a* and 172*b* and front edge 212 of cutout 204 is substantially equal to a distance between side front panel 112 and face panel 158 such that, upon assembly of package 12, front panel 160 extends substantially coplanarly with each side front panel 112.

Prior to assembly with box 16, window member 18 is folded into a three-dimensional part. For example, each of top wall 162, bottom wall 164, and sidewalls 166 and 168 are folded about a respective one of fold lines 170*a*, 170*b*, 172*a*, and 172*b* rearwardly from front wall 160 to extend substantially perpendicularly from front wall 160. In one example, since each of free side edges 176, 192, and 202 are tapered inwardly, corners of window member 18 are slightly open or at least do not result in overlapping material so as to provide a clean aesthetic look and to provide for easy assembly with box 16.

As illustrated in FIG. 12, window member 18 is assembled with folded box 16 by aligning a perimeter of front panel 160 of window member 18 with a perimeter of opening 32 of chamber 30 of box 16 and by pushing window member 18 into chamber 30. As window member 18 is slid into chamber 30, tapered edges 180 and 206 interact with corresponding tabs 94 and 106 to guide the respective tab 94 or 106 into each associated cutout 178 and 204. Continued sliding of window member 18 moves each tab 94 and 106 into an elongated portion 184 or 210 of a corresponding cutout 178 or 204. Due to the small distance between points 182 or 208 of each cutout 178 and 204, window member 18 may need to be tilted and/or otherwise adjusted as window member 18 is pushed into chamber to slide one end of each tab 94 and 106 into a corresponding elongated portion 184 and 210 at a time. The angled nature of each tapered edge 180 and 206 also helps guide tabs 94 and 106 into a respective one of elongated portions 184 and 210. Once all tabs 94 and 106 are all nested in a corresponding cutout 178 and 204, points 182 and 208 of each respective cutout 178 and 204 fit behind each tab 94 and 106 thereby generally preventing or at least greatly decreasing inadvertent movement of tabs 94 and 106 out of cutouts 178 and 204, in other words, locking each tab 94 and 106 within a corresponding cavity 178 and 204. In one example, tabs 94 and 106 are locked in respective cutouts 178 and 204 without the use of additional devices or fasteners. In this manner, each tab 94 and 106 and cutout 178 and 204 combination independently defines a locking mechanism for locking window member 18 in place relative to box 16. In one example, sliding window member 18 into place also slides portions of each of top wall 162 and sidewalls 166 and 168 that extend between corresponding cutout front edges 186 and 212 and corresponding free edges 174 and 200 snugly between one of top interior panel 46 and side interior panels 114 and one of coupling flanges 60 and 100 around face panel 58 further securing window member 18 to box 16.

By providing package 12 with a slidably lockable window member 18 to enclose products 14 within chamber 20 of box 16, manufacture of package 12 is simplified as compared to prior art packages, which generally require stocking and placement of additional fasteners such as adhesives, tapes, clips, etc. to secure a cover member to a primary box about corresponding products. In addition, by forming box 16 with an tabbed face panel 58 also couplable to a remainder of box without additional tools, and in some instances, for example, as described above, formed as an integral member with the remainder of the box 16, assembly is quite simple, easy, and repeatedly precise, which creates a more aesthetically pleasing final package 12 at a lower manufacturing cost as compared with prior art products.

Other variations of packages according to the present invention are also contemplated. For example, FIGS. 15-21 illustrate one embodiment of a package 312 including a box 316 and a window member 318. Box 316 forms a chamber 320 (FIG. 21) therein and is largely similar to box 16. However, referring to FIG. 21, unlike box 16, box 316 includes a face panel 322 that is formed as a separate piece as compared to a remainder of box 316. Face panel 322 includes coupling tabs 324 around each of outside edges 326 thereof that are received within corresponding interior facing apertures 328 in a manner similar to how tabs 94 and 106 of package 12 fit within corresponding apertures 66 and 138 thereof. While face panel 322 includes apertures 330 to facilitate coupling with products similar to face panel 58, in one embodiment, face panel 322 includes interior longitudinal fold lines 332 to form face panel features 334, such as a bump out thereof, to accommodate different features or ones of the products to be housed therein. Window member 318 defines cutouts 336, similar to cutouts 178, for lockably receiving coupling tabs 324 to secure window 318 to box 316.

Figure 28:
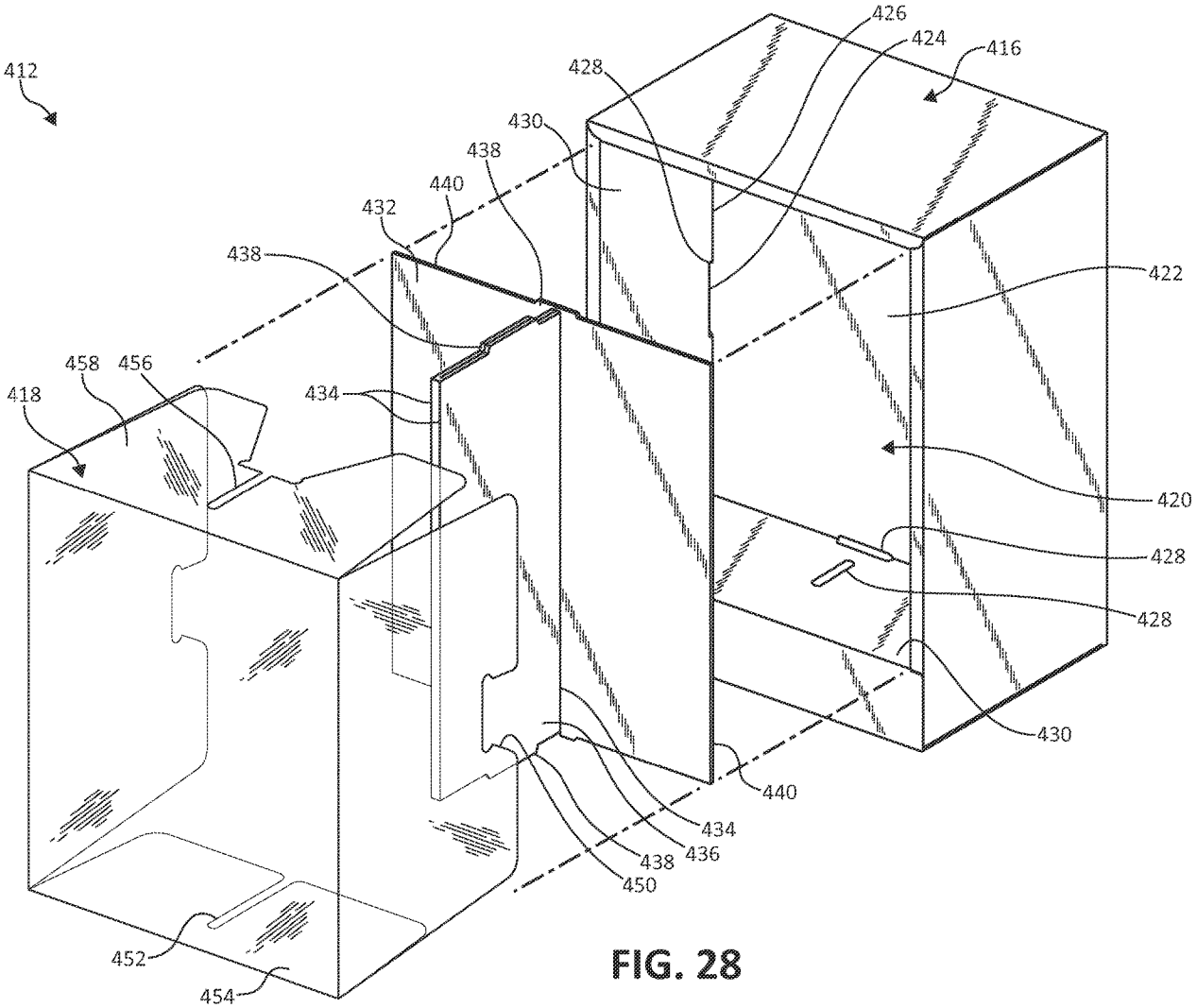
FIG. 28 is an exploded, perspective view illustration of the package of FIG. 22, according to one embodiment of the present invention.

FIGS. 22-28 illustrate one embodiment of a package 412 including a box 416 and a window member 418. Box 316 forms a chamber 420 (FIG. 28) therein and is largely similar to box 16. Referring to FIG. 28, like box 16, box 416 includes an integral face panel 422 that folds into chamber 420. Face panel 422 includes coupling tabs 424 around at each of three folded surrounding fold lines 426 thereof, that are received within corresponding interior facing apertures 428 formed through interior facing sidewalls 430 of box 416 in a manner similar to how tabs 94 and 106 of package 12 fit within corresponding apertures 66 and 138 thereof. In one example, a cover panel 430 is formed to extend directly over face panel 422.

Box 416, according to one embodiment, additionally includes a cover panel 432, which is formed as a separate piece from a remainder of box 416, to extend over face panel 422. In one example, cover panel 432 includes interior lateral fold lines 434 position to form cover panel features 436, such as a fold out ridge, to divide chamber 420 when cover panel 432 is folded along interior lateral fold lines 432. Cover panel 432 defines tabs 438 around external edges 440 thereof including along external edges 440 defined by cover panel features 434. Tabs 436 are received in corresponding apertures 428 in interior facing sidewalls 430 including both laterally and longitudinally extending apertures 428. As such, in embodiment, both one of tabs 424 of face panel 422 and one of tabs 438 of cover panel 432 are received in at least one single one of apertures 428. Other variations in cover panel 432 are also contemplated.

Window member 418 defines cutouts 450, similar to cutouts 178, for lockably receiving coupling tabs 424 to secure window 418 to box 416. In one embodiment, window member 418 additionally defines a slot 452 in a bottom sidewall 454 thereof shaped and sized similarly to a corresponding face panel feature 434 and slidably receiving the corresponding one of face panel features 436 when window member 418 is coupled with box 416. In one example, window member 418 defines a slot 456 in a top sidewall thereof that is a hybrid of slot 452 and cutouts 450 to receive a face panel feature 436 and still locking receive a corresponding tab 438. Other variations of box 16 and window member 18 (FIG. 1) are also contemplated.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A package for maintaining and displaying products, the package comprising:

a box including:

a primary panel, a plurality of internal panels collectively defining a chamber therebetween and adjacent the primary panel, wherein at least one of the plurality of internal panels defines an elongated slot facing the chamber, and a face panel extending across the chamber and spaced from the primary panel, wherein the face panel includes a tab extending outwardly from a perimeter of a remainder of the face panel, and the tab is received within the elongated slot to at least partially maintain the face panel within the chamber; and a window member including:

a first wall covering the chamber opposite the primary panel, and a second wall extending from the first wall and positioned within the chamber, the second wall defining a free edge opposite the first wall and a cutout extending from the free edge into the second wall, wherein the cutout slidably receives the tab of the face panel in a manner securely coupling the window member to the box.

2. The package of claim 1, wherein:

the cutout includes:

an elongated portion spaced from each of the first wall and the free edge of the second wall, and an inwardly tapered portion extending from the free edge of the second wall to intersect the elongated portion at two opposing points inwardly inset relative to opposing ends of the elongated portion, and the tab of the face panel is secured within the elongated portion of the cutout via interaction with the two opposing points of the window member in a manner securing the window member to the box.

3. The package of claim 1, wherein the chamber is only open via an opening opposite the primary panel, and the first wall substantially entirely covers the opening.

4. The package of claim 1, wherein the second wall is positioned immediately adjacent the at least one of the plurality of internal panels.

5. The package of claim 1, wherein the box includes a coupling flange immediately adjacent and folded relative to the face panel to extend away from the face panel and be positioned adjacent the at least one of the plurality of internal panels, and the second wall of the window member is snugly maintained between the at least one of the plurality of internal panels and the coupling flange.

6. The package of claim 1, wherein the face panel extends substantially parallel to the primary panel to define a storage space between the face panel and the primary panel.

7. The package of claim 6, wherein the window member is positioned such that a portion of the second wall extends behind the face panel toward the primary panel.

8. The package of claim 1, wherein the face panel includes at least one internal coupling feature to facilitate coupling products with the box.

9. The package of claim 8, wherein the at least one internal coupling feature is one of an aperture and an fold-out protrusion.

10. The package of claim 8, in combination with one or more products coupled to the face panel.

11. The package of claim 1, wherein the window member is substantially transparent.

12. The package of claim 1, wherein the box is formed as a single planar sheet folded to define the face panel and the plurality of internal panels, and the face panel is folded relative to a remainder of the box to extend substantially perpendicularly to each of the plurality of internal panels.

13. The package of claim 12, wherein the box includes frame segments folded across the primary panel to support front panels of the box opposite the primary panel.

14. The package of claim 1, wherein the window member is formed separately from the box.

15. The package of claim 1, wherein the first wall, and the face panel, and the primary panel extend substantially parallel to one another and substantially perpendicularly relative to each of the plurality of internal panels and the second wall.

16. The package of claim 1, wherein:

the at least one of the plurality of internal panels includes at least two opposing ones of the plurality of internal panels, the tab is a first tab, the face panel includes a second tab extending outwardly from the perimeter of face panel in a direction opposite the first tab, the second tab is received with a different one of the elongated slots, the window member includes a third wall extending from the first wall into the chamber and positioned opposite the second wall, the third wall includes a second cutout substantially identical to the cutout of the second wall, and the second cutout slidably receives the second tab of the face panel in a manner at least partially coupling the window member to the box.

17. A method of forming a package for housing products, the method comprising:

forming a box, the box including:

a primary panel, internal panels collectively defining a chamber therebetween and adjacent the primary panel, wherein at least one of the internal panels defines an elongated slot facing the chamber, and a face panel including a tab extending outwardly from a perimeter of a remainder of the face panel, wherein forming the box includes positioning the face panel to extend across the chamber in a position spaced from the primary panel including positioning the tab within the elongated slot to at least partially maintain the face panel within the chamber; and securing a window member to cover the chamber of the box, the first window member including:

a first wall covering the chamber opposite the primary panel, and a second wall extending from the first wall and positioned within the chamber, wherein the second wall defies a free edge opposite the first wall and a cutout extending from the free edge into the second wall;

wherein securing the window member to the cover includes sliding the window member into the chamber including slidably moving the cutout toward the primary panel to lockingly engage the tab of the face panel in a manner securely coupling the window member to the box.

18. The method of claim 17, wherein sliding the window member into the chamber includes sliding the second wall directly along the at least one of the internal panels.

19. A method of forming a package for housing products, the method comprising:

forming a box, the box including:

a primary panel, internal panels collectively defining a chamber therebetween and adjacent the primary panel, wherein at least one of the internal panels defines an elongated slot facing the chamber, and a face panel including a tab extending outwardly from a perimeter of a remainder of the face panel, wherein forming the box includes positioning the face panel to extend across the chamber in a position spaced from the primary panel including positioning the tab within the elongated slot to at least partially maintain the face panel within the chamber; and securing a window member to cover the chamber of the box, the first window member including:

a first wall covering the chamber opposite the primary panel, and a second wall extending from the first wall and positioned within the chamber, wherein the second wall defies a free edge opposite the first wall and a cutout extending from the free edge into the second wall;

wherein:

securing the window member to the cover includes sliding the window member into the chamber including slidably moving the cutout toward the primary panel to lockingly engage the tab of the face panel in a manner securely coupling the window member to the box, the cutout includes:

an elongated portion spaced from each of the first wall and the free edge of the second wall, and an inwardly tapered portion extending from the free edge of the second wall to intersect the elongated portion at two opposing points inwardly inset relative to opposing ends of the elongated portion, and slidably moving the cutout toward the primary panel includes moving the inwardly tapered portion along the tab to direct the tab toward the elongated portion, maneuvering the points over opposing edges of the tab, and positioning the tab within the elongated portion of the cutout such that the window member is securely coupled to the box at least partially due to interaction between the tab and the two opposing points of the window member.

20. The method of claim 17, wherein forming the box includes:

folding exterior panels forwardly from the primary panel, folding front panels relative to the exterior panels to extend substantially parallel to the primary panel toward the chamber, and folding the internal panels relative to corresponding ones of the front panels to each extend toward and to the primary panel and to define the chamber therebetween.

* * * * *